US011854504B2

(12) United States Patent
Takano et al.

(10) Patent No.: US 11,854,504 B2
(45) Date of Patent: Dec. 26, 2023

(54) DISPLAY DEVICE

(71) Applicant: Japan Display Inc., Tokyo (JP)

(72) Inventors: Daijiro Takano, Tokyo (JP); Takayuki Imai, Tokyo (JP)

(73) Assignee: Japan Display Inc., Tokyo (JP)

( * ) Notice: Subject to any disclaimer, the term of this patent is extended or adjusted under 35 U.S.C. 154(b) by 0 days.

(21) Appl. No.: 18/197,355

(22) Filed: May 15, 2023

(65) Prior Publication Data

US 2023/0377529 A1 Nov. 23, 2023

(30) Foreign Application Priority Data

May 17, 2022 (JP) ..... 2022-081057

(51) Int. Cl.
*G09G 5/10* (2006.01)
*G09G 3/36* (2006.01)

(52) U.S. Cl.
CPC ..... *G09G 3/36* (2013.01); *G09G 2310/0202* (2013.01); *G09G 2310/08* (2013.01); *G09G 2320/0257* (2013.01); *G09G 2320/0271* (2013.01); *G09G 2320/0295* (2013.01)

(58) Field of Classification Search
CPC .. G09G 5/00; G09G 5/10; G09G 5/12; G09G 5/14; G09G 3/32; G09G 3/36; G09G 2310/0202; G09G 2310/08
See application file for complete search history.

(56) References Cited

U.S. PATENT DOCUMENTS

2012/0105425 A1 5/2012 Sasanuma et al.
2013/0050528 A1* 2/2013 Hsu ..... H04N 23/843 348/E9.053
2015/0170614 A1 6/2015 Sasanuma et al.
2016/0155405 A1* 6/2016 Kim ..... G09G 3/003 345/88
2016/0275697 A1* 9/2016 Hsu ..... G06T 5/20
2018/0031758 A1 2/2018 Mizuno et al.
2020/0150490 A1 5/2020 Mizuno et al.
2021/0116759 A1 4/2021 Mizuno et al.
2022/0113593 A1 4/2022 Mizuno et al.

FOREIGN PATENT DOCUMENTS

JP 2012098400 A 5/2012
JP 2018021974 A 2/2018

* cited by examiner

*Primary Examiner* — Chanh D Nguyen
*Assistant Examiner* — Nguyen H Truong
(74) *Attorney, Agent, or Firm* — K&L Gates LLP

(57) ABSTRACT

A display device includes: a display panel having a display region in which pixels are arranged; scan lines each coupled to the pixels arranged in a row direction; signal lines each coupled to the pixels arranged in a column direction; a signal line drive circuit; a scan line drive circuit selecting the scan lines; and a signal processing circuit. A second half period of a selection period of a first scan line overlaps a first half period of a selection period of a second scan line. The signal processing circuit adjusts a pixel gradation value of the pixel in an m-th column coupled to the second scan line when a difference value between the pixel gradation value of the pixel in the m-th column coupled to the first scan line and an average gradation value of the pixels arranged in the m-th column is larger than a predetermined value.

5 Claims, 21 Drawing Sheets

DISPLAY DEVICE

CROSS-REFERENCE TO RELATED APPLICATION

This application claims the benefit of priority from Japanese Patent Application No. 2022-081057 filed on May 17, 2022, the entire contents of which are incorporated herein by reference.

BACKGROUND

1. Technical Field

What is disclosed herein relates to a display device.

2. Description of the Related Art

It is known that there is a display device what is called a transparent display (transmissive display) that includes a first light-transmitting substrate, a second light-transmitting substrate disposed so as to face the first light-transmitting substrate, a liquid crystal layer including polymer-dispersed liquid crystals filled between the first and the second light-transmitting substrates, and at least one light emitter disposed so as to face at least one of side surfaces of the first and the second light-transmitting substrates.

The display device described above is driven based on what is called a field-sequential system that causes light emitters configured to emit light in three colors of red (R), green (G), and blue (B) to emit light in a time-division manner. In this field-sequential system, the light emission period is preferably relatively longer than a gate scan period for pixel transistors within one field period. It is disclosed that there is a display device that performs gate-overlap drive to cause the on-periods of gate signals for a plurality of gate signal lines to overlap one another to support the increase in definition of the display.

In a transparent display using the field-sequential system, it is assumed that text information (e.g., subtitles) that requires pixels to be driven at a high voltage is displayed on a screen that is driven at a low voltage as a whole. In this case, between pixels of which gate-on periods overlap, signals supplied to pixels driven at high voltages apply high potentials to liquid crystal molecules of pixels driven at low voltages. As a result, electric charges that have charged the liquid crystal molecules of the pixels driven at the low voltages are not sufficiently discharged, and thus, the potentials of the pixels that are originally driven at the low voltages may be kept at the high potentials, resulting in an occurrence of ghosting.

For the foregoing reasons, there is a need for a display device capable of reducing the ghosting caused pixels driven at high voltages.

SUMMARY

According to an aspect, a display device includes: a display panel having a display region in which a plurality of pixels are arranged in a matrix having a row-column configuration; a plurality of scan lines each coupled to the pixels arranged in a row direction; a plurality of signal lines each coupled to the pixels arranged in a column direction; a signal line drive circuit configured to supply, to each of the signal lines, a gradation signal corresponding to a pixel gradation value of each of the pixels arranged in the column direction; a scan line drive circuit configured to select the scan lines; and a signal processing circuit configured to adjust the pixel gradation value. The scan lines include a first scan line and a second scan line. A second half period of a selection period of the first scan line overlaps a first half period of a selection period of the second scan line. The signal processing circuit is configured to adjust the pixel gradation value of the pixel in an m-th column (where m is a natural number) coupled to the second scan line when a difference value between the pixel gradation value of the pixel in the m-th column coupled to the first scan line and an average gradation value of the pixels arranged in the m-th column is larger than a predetermined value.

DETAILED DESCRIPTION

Figure 1:
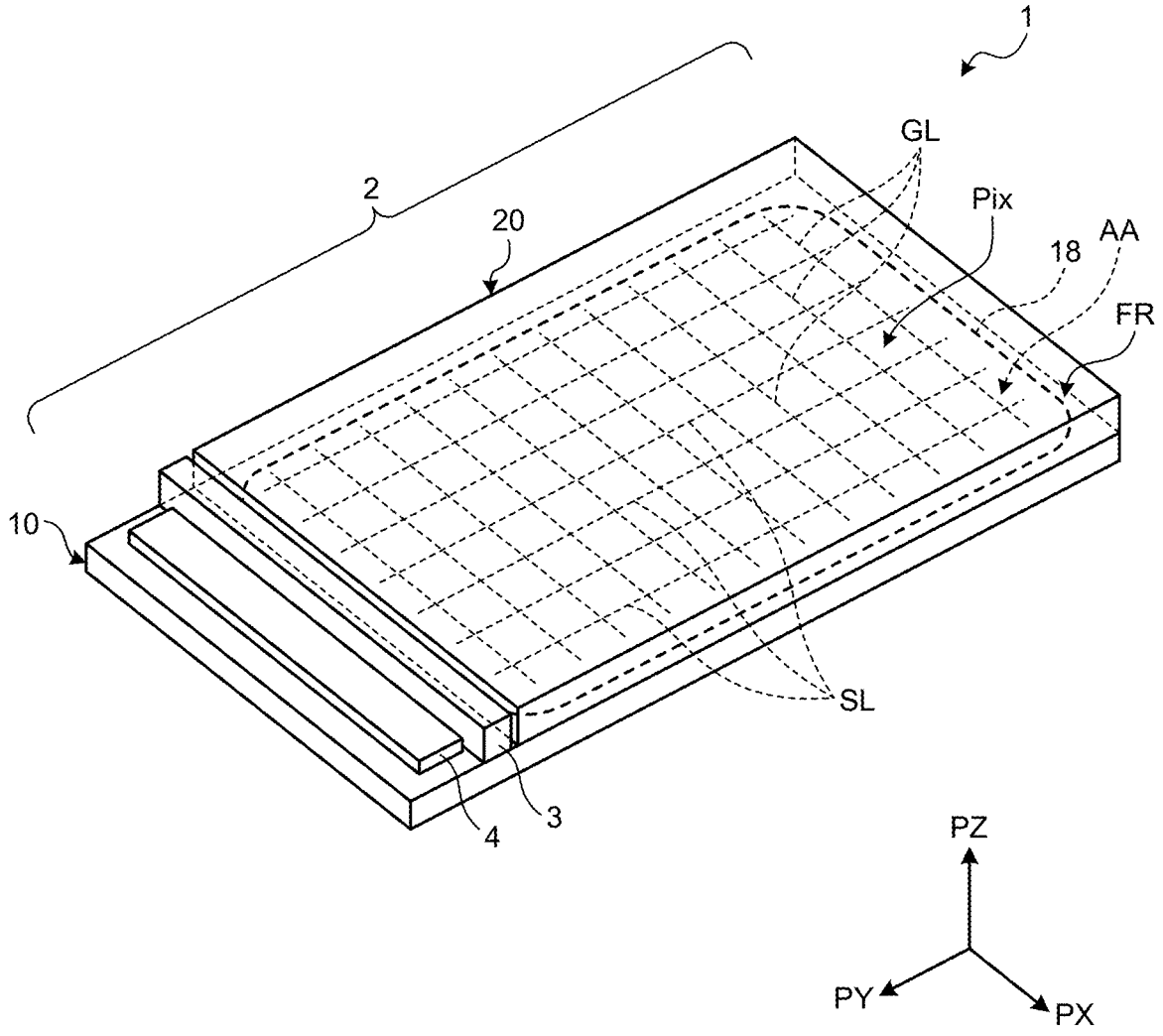
FIG. 1 is a perspective view illustrating an example of a display device according to a first embodiment.

The following describes modes (embodiments) for carrying out the present disclosure in detail with reference to the drawings. The present disclosure is not limited to the description of the embodiments given below. Components described below include those easily conceivable by those skilled in the art or those substantially identical thereto. In addition, the components described below can be combined as appropriate. What is disclosed herein is merely an example, and the present disclosure naturally encompasses appropriate modifications easily conceivable by those skilled in the art while maintaining the gist of the disclosure. To further clarify the description, the drawings schematically illustrate, for example, widths, thicknesses, and shapes of various parts as compared with actual aspects thereof, in some cases. However, they are merely examples, and interpretation of the present disclosure is not limited thereto. The same element as that illustrated in a drawing that has already been discussed is denoted by the same reference numeral through the description and the drawings, and detailed description thereof will not be repeated in some cases where appropriate.

In this disclosure, when an element is described as being "on" another element, the element can be directly on the other element, or there can be one or more elements between the element and the other element.

First Embodiment

Figure 2:
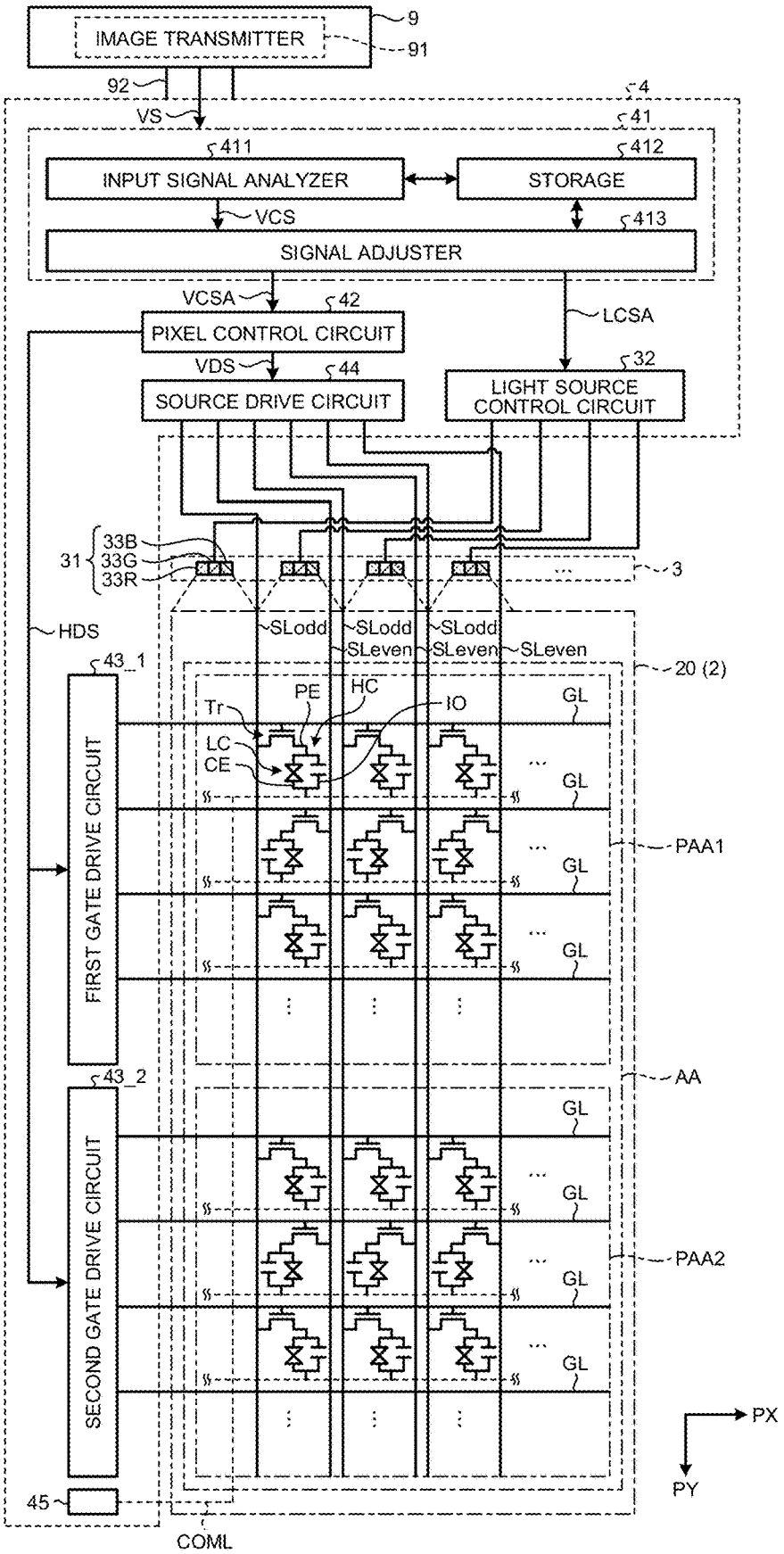
FIG. 2 is a block diagram illustrating an exemplary schematic configuration of the display device according to the first embodiment.
Figure 3:
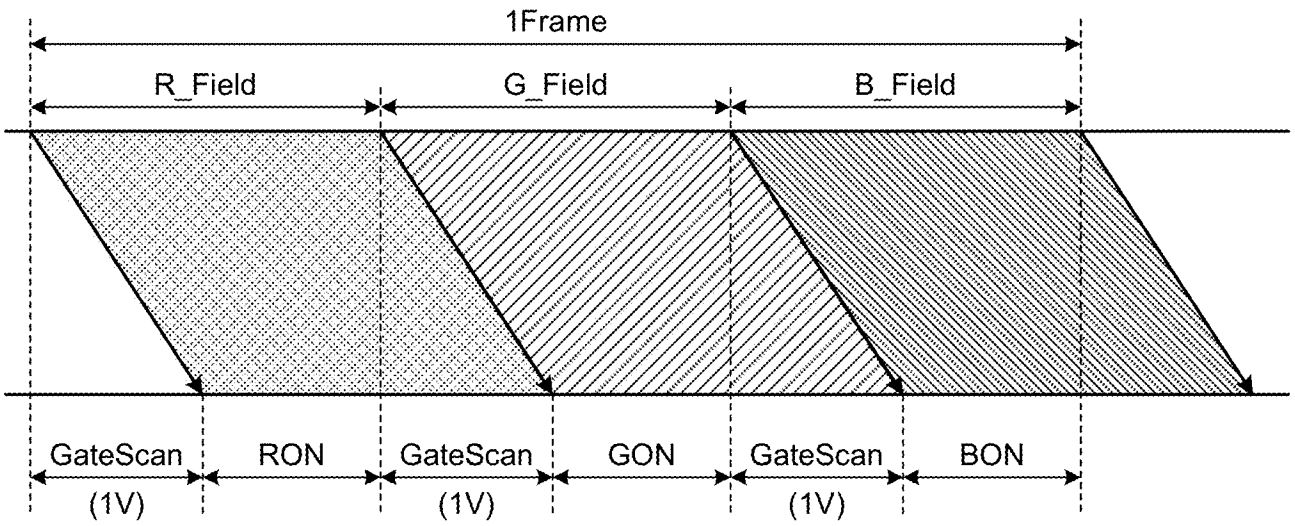
FIG. 3 is a timing diagram explaining timing of light emission by a light source in a field-sequential system.

FIG. 1 is a perspective view illustrating an example of a display device according to a first embodiment. FIG. 2 is a block diagram illustrating an exemplary schematic configuration of the display device according to the first embodiment. FIG. 3 is a timing diagram explaining timing of light emission by a light source in a field-sequential system.

As illustrated in FIG. 1, a display device 1 includes a display panel 2, a light source 3, and a drive circuit 4. A first direction PX denotes one direction in the plane of the display panel 2. A second direction PY denotes a direction orthogonal to the first direction PX. A third direction PZ denotes a direction orthogonal to the PX-PY plane.

Figure 5:
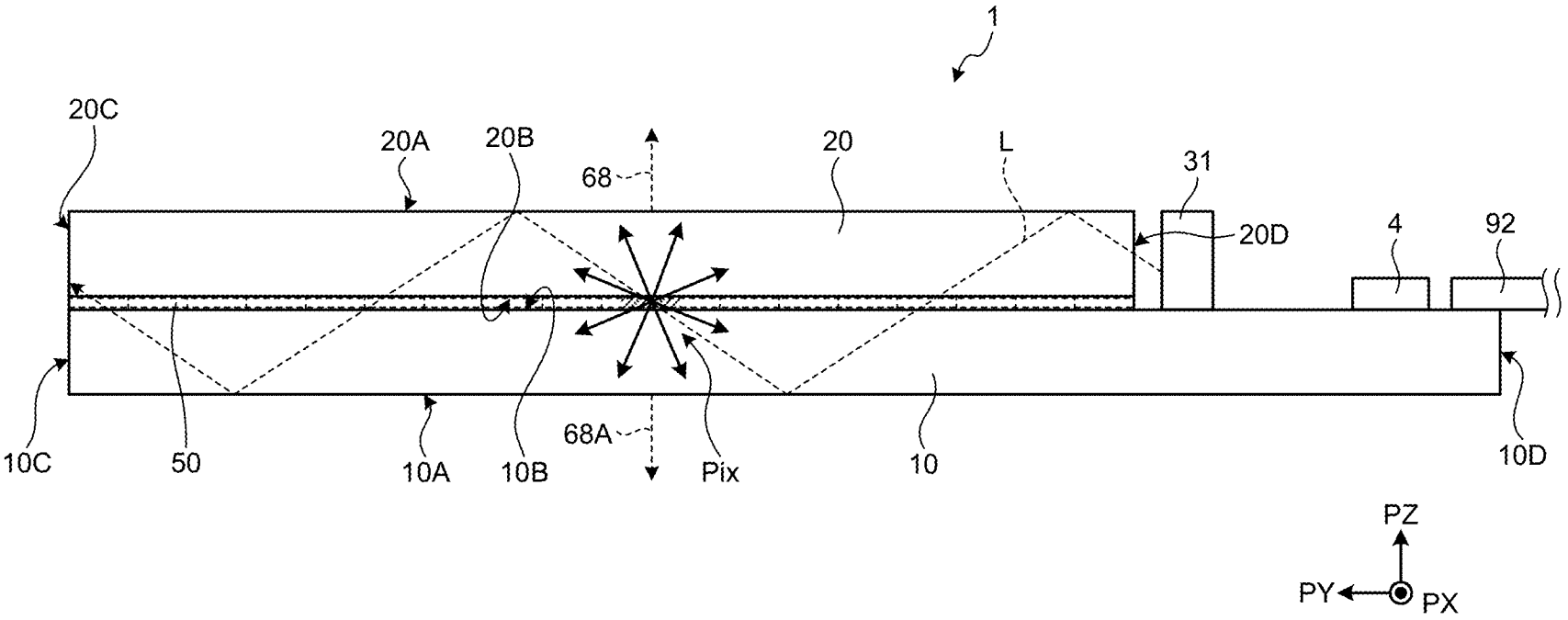
FIG. 5 is a sectional view illustrating an example of a section of the display device of FIG. 1.

The display panel 2 includes an array substrate 10, a counter substrate 20, and a liquid crystal layer 50 (refer to FIG. 5). The counter substrate 20 faces a surface of the array substrate 10 in a direction orthogonal thereto (in the direction PZ illustrated in FIG. 1). In the liquid crystal layer 50 (refer to FIG. 5), polymer-dispersed liquid crystals LC (to be described later) are sealed by the array substrate 10, the counter substrate 20, and a sealing portion 18.

As illustrated in FIG. 1, the display panel 2 has a display region AA capable of displaying images and a peripheral region FR outside the display region AA. A plurality of pixels Pix are arranged in a matrix having a row-column configuration in the display region AA. In the present disclosure, a row refers to a pixel row including M pixels Pix arranged in one direction (first direction PX). A column refers to a pixel column including N pixels Pix arranged in a direction (second direction PY) orthogonal to the direction in which the rows extend. The values of M and N are determined depending on a display resolution in the vertical direction and a display resolution in the horizontal direction. A plurality of scan lines GL are provided corresponding to the rows, and a plurality of signal lines SL are provided corresponding to the columns.

The light source 3 includes a plurality of light emitters 31. As illustrated in FIG. 2, the drive circuit 4 includes a light source controller (light source control circuit) 32. The light emitters 31 and the light source controller 32 may be circuits separate from the drive circuit 4. The light emitters 31 are electrically coupled to the light source controller 32 through wiring in the array substrate 10. When the light emitters 31 and the light source control circuit 32 are provided using a member separate from the display panel 2, the light source control circuit 32 may be controlled independently of the drive circuit 4.

As illustrated in FIG. 1, the drive circuit 4 is fixed to the surface of the array substrate 10. As illustrated in FIG. 2, the drive circuit 4 includes a signal processing circuit 41, a pixel control circuit 42, a first gate drive circuit (first scan line drive circuit) 43_1, a second gate drive circuit (second scan line drive circuit) 43_2, a source drive circuit (signal line drive circuit) 44, and a common potential drive circuit 45. The array substrate 10 has an area in an XY plane larger than that of the counter substrate 20, and the drive circuit 4 is provided on a projecting portion of the array substrate 10 exposed from the counter substrate 20.

The signal processing circuit 41 receives a first input signal (such as a red-green-blue (RGB) signal) VS from an image transmitter 91 of an external higher-level controller 9 through a flexible substrate 92.

The signal processing circuit 41 includes an input signal analyzer 411, a storage 412, and a signal adjuster 413.

The input signal analyzer 411 generates a second input signal VCS based on the externally received first input signal VS.

The first input signal VS is a parallel RGB signal of 18-bits (6 bits for each of R, G, and B) or 24-bits (8 bits for each of R, G, and B), for example. The first input signal VS is a signal containing color depth information about the number of colors in the RGB signal. The first input signal VS is transmitted in a known data format from the external higher-level controller 9.

The second input signal VCS is a signal for determining a gradation value to be given to each of the pixels Pix of the display panel 2. In other words, the second input signal VCS is a signal including gradation information on the gradation value of each of the pixels Pix.

The signal adjuster 413 generates a third input signal VCSA from the second input signal VCS. The signal adjuster 413 transmits the third input signal VCSA to the pixel control circuit 42, and transmits a light source control signal LCSA to the light source controller 32. The light source control signal LCSA is a signal including information on light quantities of the light emitters 31 set in accordance with, for example, input gradation values given to the pixels Pix. For example, when a darker image is displayed, the light quantities of the light emitters 31 are set smaller. When a brighter image is displayed, the light quantities of the light emitters 31 are set larger. The light quantities of the light emitters 31 may be kept constant, and the degree of scattering of the liquid crystals (to be described later) may be controlled by, for example, a gradation signal of a vertical drive signal VDS, that is, a pixel voltage applied to a pixel electrode PE.

The storage 412 is a buffer memory that temporarily stores therein the first input signal VS and the second input signal VCS.

In the present embodiment, the signal adjuster 413 reads the second input signal VCS temporarily stored in the storage 412 and performs predetermined image processing. Specifically, the signal adjuster 413 changes the second input signal VCS to, for example, a signal having a format that can be displayed on the display panel 2 in the subsequent stage. The signal adjuster 413 performs the process in accordance with the selection order of the scan lines GL in the first gate drive circuit 43_1 and the second gate drive circuit 43_2. In the present embodiment, the signal adjuster 413 performs, for example, interchange of pixel data and adjustment processing of the pixel gradation values in accordance with the selection order of the scan lines GL. The adjustment processing of the pixel gradation values in the present embodiment will be described later.

The pixel control circuit 42 generates a horizontal drive signal HDS and the vertical drive signal VDS based on the third input signal VCSA. In the present embodiment, since the display device 1 is driven using the field-sequential system, the horizontal drive signal HDS and the vertical drive signal VDS are generated for each color emittable by the light emitters 31.

In the present embodiment, the display panel 2 is an active-matrix panel. For that reason, the display panel 2 includes the signal (source) lines SL extending in the second direction PY and the scan (gate) lines GL extending in the first direction PX in plan view and includes switching elements Tr at intersecting portions between the signal lines SL (SLodd and SLeven) and the scan lines GL. Each of the pixels Pix in the display region AA is provided with a corresponding one of the switching elements Tr.

The first gate drive circuit 43_1 and the second gate drive circuit 43_2 sequentially select the scan lines GL of the display panel 2 based on the horizontal drive signal HDS within one vertical scan period (1V).

In the present embodiment, the display region AA is divided into two regions of a first partial region PAA1 and a second partial region PAA2 in the column direction (second direction PY). The number of the pixels Pix arranged in the column direction (second direction PY) in each of the first partial region PAA1 and the second partial region PAA2 is N/2. That is, the display region AA in which N pixels Pix are arranged in the column direction (second direction PY) is divided into two equal regions. The first gate drive circuit 43_1 is provided corresponding to the first partial region PAA1. The second gate drive circuit 43_2 is provided corresponding to the second partial region PAA2. That is, the first gate drive circuit 43_1 selects the scan lines GL(1), GL(2), . . . , GL(N/2) in the first partial region PAA1, and the second gate drive circuit 43_2 selects the scan lines GL(N/2+1), GL(N/2+2), . . . , GL(N) in the second partial region PAA2.

The source drive circuit 44 supplies gradation signals corresponding to output gradation values of the pixels Pix to the signal lines SLodd and SLeven of the display panel 2 based on the vertical drive signal VDS within one horizontal scan period (1H). In the present embodiment, the signal lines SLodd are coupled to the pixels Pix in the odd-numbered rows, and the signal lines SLeven are coupled to the pixels Pix in the even-numbered rows.

The configuration of the signal processing circuit 41 is exemplary and not limited to the configuration described above. For example, in an aspect, one gate drive circuit may be used to select the scan lines GL in the entire display region AA.

A thin-film transistor is used as the switching element Tr provided in each of the pixels Pix. A bottom-gate transistor or a top-gate transistor may be used as an example of the thin-film transistor. Although a single-gate thin film transistor is exemplified as the switching element Tr, the switching element Tr may be a double-gate transistor. One of the source electrode and the drain electrode of the switching element Tr is coupled to a corresponding one of the signal lines SL. The gate electrode of the switching element Tr is coupled to a corresponding one of the scan lines GL. The other of the source electrode and the drain electrode is coupled to one end of a capacitor of the polymer-dispersed liquid crystals LC to be described later. The capacitor of the polymer-dispersed liquid crystals LC is coupled at one end thereof to the switching element Tr through a pixel electrode PE, and coupled at the other end thereof to common potential wiring COML through a common electrode CE. Holding capacitance HC is generated between the pixel electrode PE and a holding capacitance electrode IO electrically coupled to the common potential wiring COML. A potential of the common potential wiring COML is supplied by the common potential drive circuit 45.

Each of the light emitters 31 includes a light emitter 33R of a first color (such as red), a light emitter 33G of a second color (such as green), and a light emitter 33B of a third color (such as blue). The light source controller 32 controls the light emitter 33R of the first color, the light emitter 33G of the second color, and the light emitter 33B of the third color so as to emit light in a time-division manner based on the light source control signal LCSA. In this manner, the light emitter 33R of the first color, the light emitter 33G of the second color, and the light emitter 33B of the third color are driven based on the field-sequential system.

In a period R_Field illustrated in FIG. 3, the light emitter 33R of the first color emits light during a first color light emission period RON, and the pixels Pix selected within one vertical scan period (1V) GateScan scatter light to perform display. On the entire display panel 2, if the gradation signals corresponding to the output gradation values of the pixels Pix are supplied to the above-mentioned signal lines SL for the pixels Pix selected within the one vertical scan period (1V) GateScan, only the first color is lit up during the first color light emission period RON.

Then, in a period G_Field, the light emitter 33G of the second color emits light during a second color light emission period GON, and the pixels Pix selected within the one vertical scan period (1V) GateScan scatter light to perform display. On the entire display panel 2, if the gradation signals corresponding to the output gradation values of the pixels Pix are supplied to the above-mentioned signal lines SL for the pixels Pix selected within the one vertical scan period (1V) GateScan, only the second color is lit up during the second color light emission period GON.

Furthermore, in a period B_Field, the light emitter 33B of the third color emits light during a third color light emission period BON, and the pixels Pix selected within the one vertical scan period (1V) GateScan scatter light to perform display. On the entire display panel 2, if the gradation signals corresponding to the output gradation values of the pixels Pix are supplied to the above-mentioned signal lines SL for the pixels Pix selected within the one vertical scan period (1V) GateScan, only the third color is lit up during the third color light emission period BON.

Since a human eye has limited temporal resolving power, and produces an afterimage, an image with a combination of three colors is recognized in one frame period (1Frame). The field-sequential system can eliminate the need for a color filter, and thus can reduce an absorption loss by the color filter. As a result, higher transmittance can be obtained. In the color filter system, one pixel is made up of sub-pixels obtained by dividing each of the pixels Pix into the sub-pixels of the first color, the second color, and the third color. In contrast, in the field-sequential system, the pixel need not be divided into the sub-pixels in such a manner. A fourth sub-frame may be further included to emit light in a fourth color different from any one of the first color, the second color, and the third color.

Figure 4:
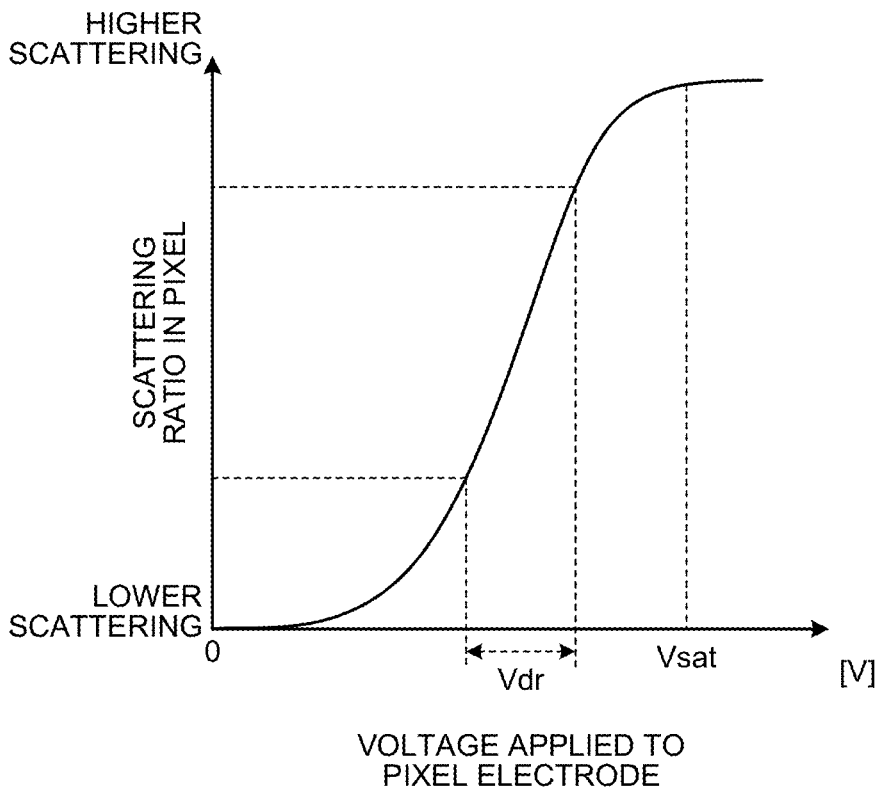
FIG. 4 is an explanatory diagram illustrating a relation between a voltage applied to a pixel electrode and a scattering state of a pixel.
Figure 6:
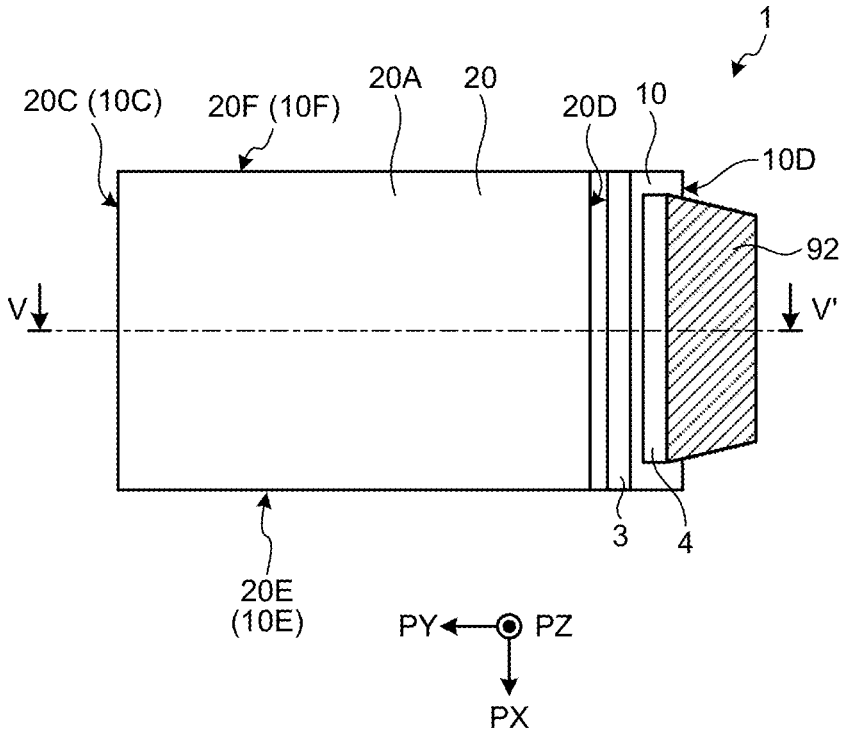
FIG. 6 is a plan view illustrating a planar surface of the display device of FIG. 1.
Figure 7:
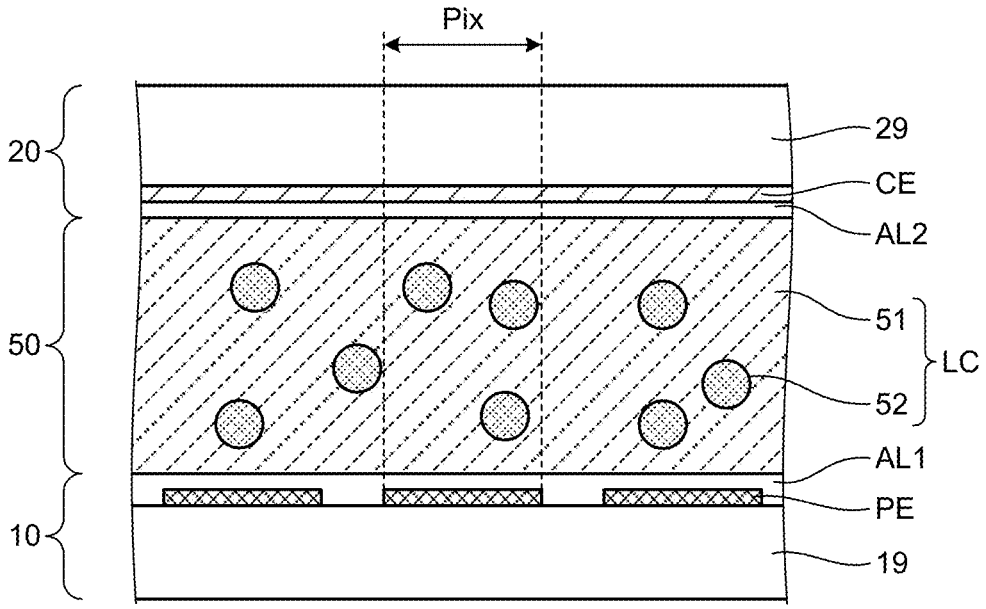
FIG. 7 is an enlarged sectional view obtained by enlarging a liquid crystal layer portion of FIG. 5.
Figure 8:
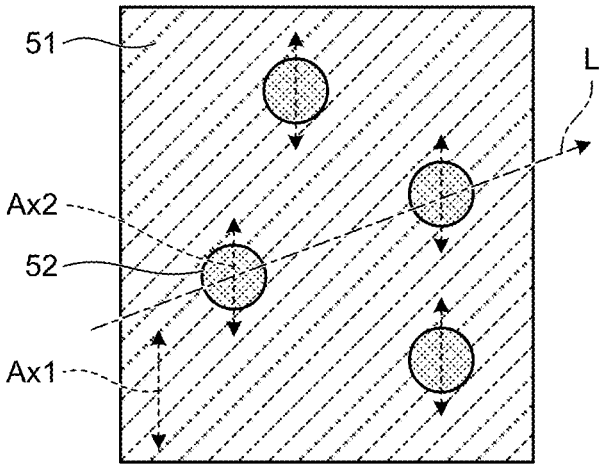
FIG. 8 is a sectional view for explaining a non-scattering state in the liquid crystal layer.
Figure 9:
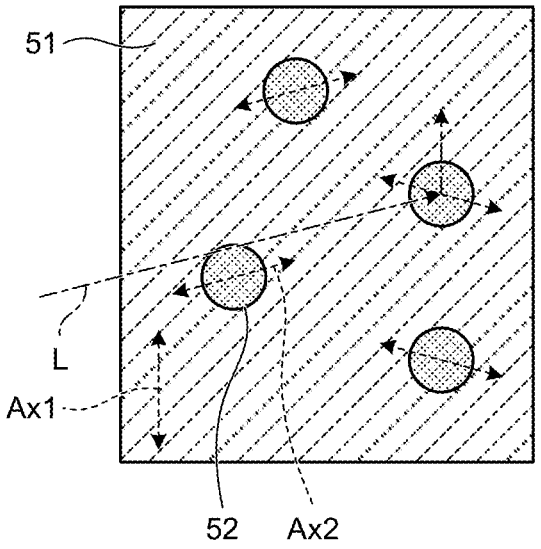
FIG. 9 is a sectional view for explaining the scattering state in the liquid crystal layer.

FIG. 4 is an explanatory diagram illustrating a relation between a voltage applied to the pixel electrode and a scattering state of the pixel. FIG. 5 is a sectional view illustrating an example of a section of the display device of FIG. 1. FIG. 6 is a plan view illustrating a planar surface of the display device of FIG. 1. FIG. 5 is a V-V' sectional view of FIG. 6. FIG. 7 is an enlarged sectional view obtained by enlarging the liquid crystal layer portion of FIG. 5. FIG. 8 is a sectional view for explaining a non-scattering state in the liquid crystal layer. FIG. 9 is a sectional view for explaining the scattering state in the liquid crystal layer.

If the gradation signal corresponding to the output gradation value of each of the pixels Pix is supplied to the above-described signal lines SL for the pixels Pix selected during the one vertical scan period (1V) GateScan, the voltage applied to the pixel electrode PE changes with the gradation signal. The change in the voltage applied to the pixel electrode PE changes the voltage between the pixel electrode PE and the common electrode CE. The scattering state of the liquid crystal layer 50 for each of the pixels Pix is controlled in accordance with the voltage applied to the pixel electrode PE, and the scattering ratio in the pixels Pix changes, as illustrated in FIG. 4.

As illustrated in FIG. 4, the change in the scattering ratio in the pixel Pix is smaller when the voltage applied to the pixel electrode PE is equal to or higher than a saturation voltage Vsat. Therefore, the drive circuit 4 changes the voltage applied to the pixel electrode PE in accordance with the vertical drive signal VDS within a voltage range Vdr lower than the saturation voltage Vsat.

As illustrated in FIGS. 5 and 6, the array substrate 10 has a first principal surface 10A, a second principal surface 10B, a first side surface 10C, a second side surface 10D, a third side surface 10E, and a fourth side surface 10F. The first principal surface 10A and the second principal surface 10B are parallel flat surfaces. The first side surface 10C and the second side surface 10D are parallel flat surfaces. The third side surface 10E and the fourth side surface 10F are parallel flat surfaces.

As illustrated in FIGS. 5 and 6, the counter substrate 20 has a first principal surface 20A, a second principal surface 20B, a first side surface 20C, a second side surface 20D, a third side surface 20E, and a fourth side surface 20F. The first principal surface 20A and the second principal surface 20B are parallel flat surfaces. The first side surface 20C and the second side surface 20D are parallel flat surfaces. The third side surface 20E and the fourth side surface 20F are parallel flat surfaces.

As illustrated in FIGS. 5 and 6, the light source 3 faces the second side surface 20D of the counter substrate 20. The light source 3 may also be called a side light source. As illustrated in FIG. 5, the light source 3 emits light-source light L to the second side surface 20D of the counter substrate 20. The second side surface 20D of the counter substrate 20 facing the light source 3 serves as a plane of light incidence. Although not illustrated, the structure may be such that a cover glass is provided on the first principal surface 20A of the counter substrate 20, and the light source 3 is disposed to face a side surface of the cover glass, in which case the side surface of the cover glass facing the light source serves as the plane of light incidence. The cover glass is also a substrate facing the array substrate 10 in the same manner as the counter substrate 20.

As illustrated in FIG. 5, the light-source light L emitted from the light source 3 propagates in a direction (second direction PY) away from the second side surface 20D while being reflected by the first principal surface 10A of the array substrate 10 and the first principal surface 20A of the counter substrate 20. When the light-source light L travels outward from the first principal surface 10A of the array substrate 10 or the first principal surface 20A of the counter substrate 20, the light-source light L enters a medium having a lower refractive index from a medium having a higher refractive index. Hence, if the angle of incidence of the light-source light L incident on the first principal surface 10A of the array substrate 10 or the first principal surface 20A of the counter substrate 20 is larger than a critical angle, the light-source light L is totally reflected by the first principal surface 10A of the array substrate 10 or the first principal surface 20A of the counter substrate 20.

As illustrated in FIG. 5, the light-source light L that has propagated in the array substrate 10 and the counter substrate 20 is scattered by any of the pixels Pix including the liquid crystals placed in the scattering state, and the angle of incidence of the scattered light becomes an angle smaller than the critical angle. Thus, emission light 68 and 68A are emitted outward from the first principal surface 20A of the counter substrate 20 and the first principal surface 10A of the array substrate 10, respectively. The emission light 68 or 68A emitted outward from the first principal surface 20A of the counter substrate 20 or the first principal surface 10A of the array substrate 10, respectively, is viewed by a viewer. The following describes the polymer-dispersed liquid crystals placed in the scattering state and the polymer-dispersed liquid crystals in the non-scattering state, using FIGS. 7 to 9.

As illustrated in FIG. 7, the array substrate 10 is provided with a first orientation film AL1. The counter substrate 20 is provided with a second orientation film AL2. The first and the second orientation films AL1 and AL2 are horizontal orientation films, for example.

A solution containing the liquid crystals and a monomer is filled between the array substrate 10 and the counter substrate 20. Then, in a state where the monomer and the liquid crystals are oriented by the first and the second orientation films AL1 and AL2, the monomer is polymerized by ultraviolet rays or heat to form a bulk 51. This process forms the liquid crystal layer 50 including the reverse-mode polymer-dispersed liquid crystals LC in which the liquid crystals are dispersed in gaps of a polymer network formed in a mesh shape. As an example, the orientation directions of the first and second orientation films AL1 and AL2 are parallel to the first direction PX.

In this manner, the polymer-dispersed liquid crystals LC include the bulk 51 formed of the polymer and a plurality of fine particles 52 dispersed in the bulk 51. The fine particles 52 are formed of the liquid crystals. Both the bulk 51 and the fine particles 52 have optical anisotropy.

The orientation of the liquid crystals included in the fine particles 52 is controlled by a voltage difference between the pixel electrode PE and the common electrode CE. The orientation of the liquid crystals is changed by the voltage applied to the pixel electrode PE. The degree of scattering of light passing through the pixels Pix changes with change in the orientation of the liquid crystals.

For example, as illustrated in FIG. 8, when no voltage is applied between the pixel electrode PE and the common electrode CE, the direction of an optical axis Ax1 of the bulk 51 is equal to the direction of an optical axis Ax2 of the fine particles 52. The optical axis Ax2 of the fine particles 52 is parallel to the direction PZ of the liquid crystal layer 50. The optical axis Ax1 of the bulk 51 is parallel to the direction PZ of the liquid crystal layer 50 regardless of whether a voltage is applied.

Ordinary-ray refractive indices of the bulk 51 and the fine particles 52 are equal to each other. When no voltage is applied between the pixel electrode PE and the common electrode CE, the difference of refractive index between the bulk 51 and the fine particles 52 is zero in all directions. The liquid crystal layer 50 is placed in the non-scattering state of not scattering the light-source light L. The light-source light L propagates in a direction away from the light source 3 (the light emitter 31) while being reflected by the first principal surface 10A of the array substrate 10 and the first principal surface 20A of the counter substrate 20. When the liquid crystal layer 50 is in the non-scattering state of not scattering the light-source light L, a background on the first principal surface 20A side of the counter substrate 20 is visible from the first principal surface 10A of the array substrate 10, and a background on the first principal surface 10A side of the array substrate 10 is visible from the first principal surface 20A of the counter substrate 20.

As illustrated in FIG. 9, in the gap between the pixel electrode PE and the common electrode CE to which a voltage is applied, the optical axis Ax2 of the fine particles 52 is inclined by an electric field generated between the pixel electrode PE and the common electrode CE. Since the optical axis Ax1 of the bulk 51 is not changed by the electric field, the direction of the optical axis Ax1 of the bulk 51 differs from the direction of the optical axis Ax2 of the fine particles 52. The light-source light L is scattered in the pixel Pix including the pixel electrode PE to which the voltage is applied. As described above, the viewer views a portion of the scattered light-source light L emitted outward from the first principal surface 10A of the array substrate 10 or the first principal surface 20A of the counter substrate 20.

In the pixel Pix including the pixel electrode PE to which no voltage is applied, the background on the first principal surface 20A side of the counter substrate 20 is visible from the first principal surface 10A of the array substrate 10, and the background on the first principal surface 10A side of the array substrate 10 is visible from the first principal surface 20A of the counter substrate 20. In the display device 1 of the present embodiment, when the first input signal VS is received from the image transmitter 91, a voltage is applied to the pixel electrode PE of the pixel Pix for displaying an image, and the image based on the third input signal VCSA becomes visible together with the background. In this manner, an image is displayed in the display region when the polymer-dispersed liquid crystals are in the scattering state.

The light-source light L is scattered in the pixel Pix including the pixel electrode PE to which the voltage is applied, and emitted outward to display the image, which is displayed so as to be superimposed on the background. In other words, the display device 1 of the present embodiment displays the image so as to be superimposed on the background by combining the emission light 68 or the emission light 68A with the background.

Figure 10:
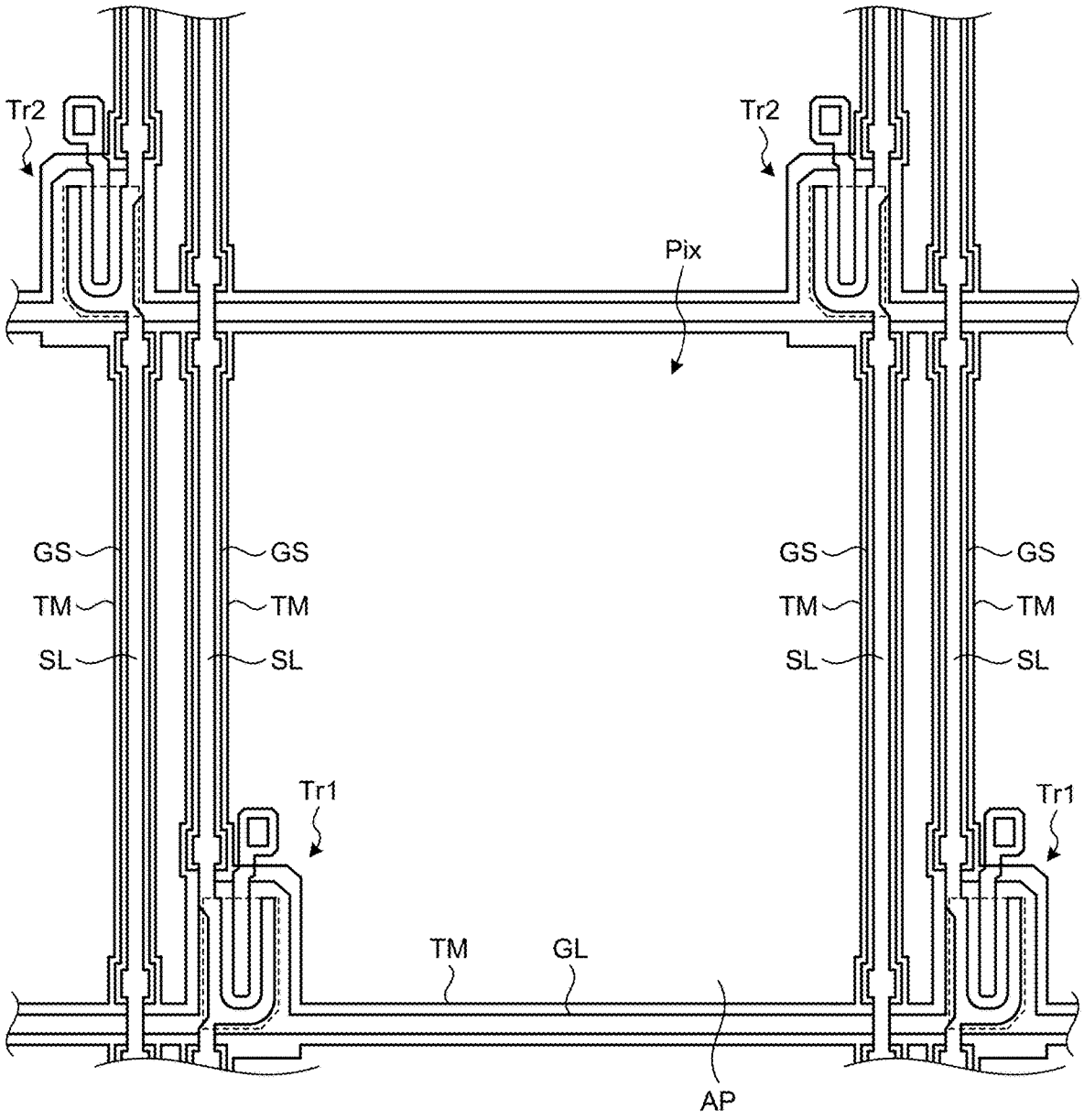
FIG. 10 is a plan view illustrating a schematic configuration of the pixel.

FIG. 10 is a plan view illustrating a schematic configuration of the pixel. As illustrated in FIG. 10, the pixel Pix is provided with the switching element Tr (Tr1 or Tr2). In the present embodiment, the switching element Tr (Tr1 or Tr2) is a bottom-gate thin-film transistor.

A metal layer TM is provided in a region overlapping the signal lines SL, the scan lines GL, and the switching elements Tr in plan view. As a result, the metal layer TM is formed into a grid shape, and an opening AP surrounded by the metal layer TM is formed.

In the present embodiment, the configuration of pixels Pix is such that two of signal lines SL are provided between the adjacent pixels Pix as illustrated in FIG. 10. One of the signal lines SL is electrically coupled to the switching element Tr1 located at an intersecting portion between the signal line SL and the scan line GL for every other pixel Pix. The other of the signal lines SL is electrically coupled to the switching element Tr2 located at an intersecting portion between the signal line SL and the scan line GL for every other pixel Pix except the pixel Pix having the switching element Tr1.

This configuration allows the first gate drive circuit 43_1 and the second gate drive circuit 43_2 to simultaneously select adjacent two of the scan lines GL. As a result, the one vertical scan period (1V) GateScan illustrated in FIG. 3 is reduced. The reduction of the one vertical scan period (1V) GateScan relatively increases each of the first color light emission period RON, the second color light emission period GON, and the third color light emission period BON after the one vertical scan period (1V) GateScan.

Figure 11:
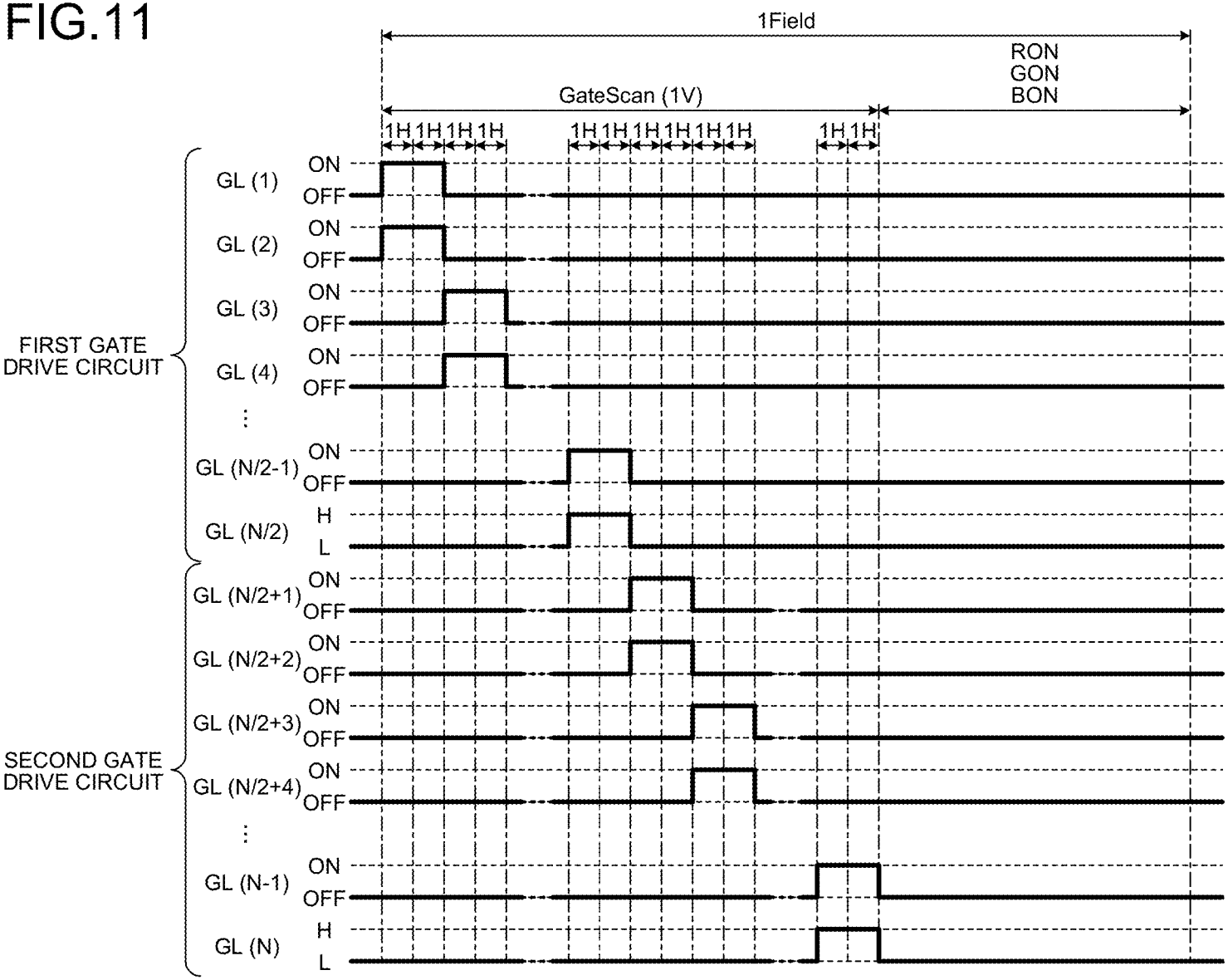
FIG. 11 is a timing diagram illustrating a scan line drive example according to a comparative example.

FIG. 11 is a timing diagram illustrating a scan line drive example according to a comparative example. FIG. 11 illustrates the one vertical scan period (1V) GateScan and the light emission periods RON, GON, and BON in 1 Field period.

In the scan line drive example according to the comparative example, the two adjacent scan lines GL are simultaneously selected in sequence in two horizontal scan periods (2H), as illustrated in FIG. 11. This operation can relatively increase the light emission periods RON, GON, and BON within 1 Field period. Hereinafter, the period selected by the first gate drive circuit 43_1 or the second gate drive circuit 43_2 is also called "gate-on period".

Figure 12:
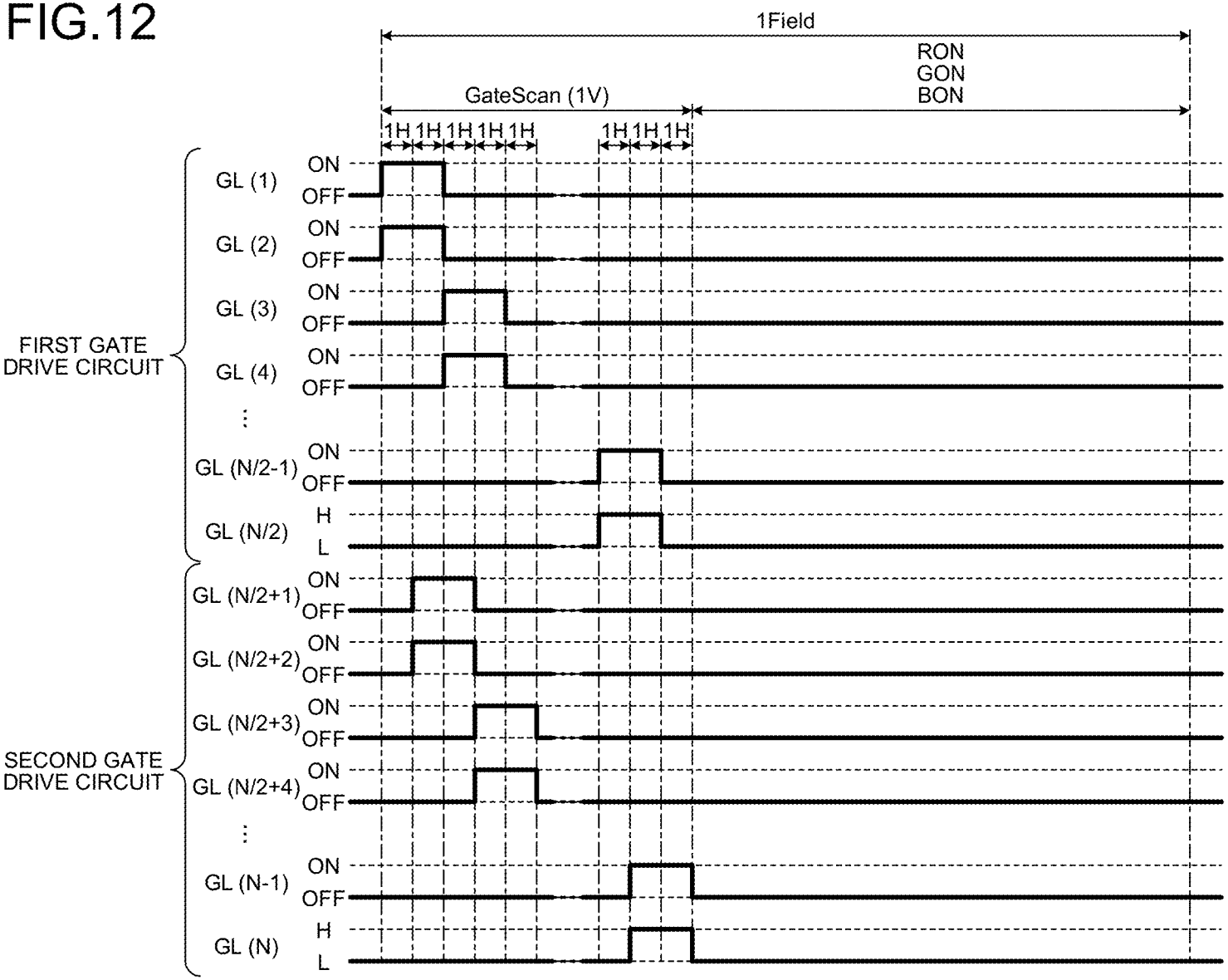
FIG. 12 is a timing diagram illustrating a scan line drive example according to the first embodiment.

FIG. 12 is a timing diagram illustrating a scan line drive example according to the first embodiment. FIG. 12 illustrates the one vertical scan period (1V) GateScan and the light emission periods RON, GON, and BON in 1 Field period, in the same manner as FIG. 11.

In the scan line drive example according to the present embodiment illustrated in FIG. 12, the two adjacent scan lines GL are simultaneously selected in the two horizontal scan periods (2H) in the same manner as in the scan line drive example according to the comparative example illustrated in FIG. 11. Furthermore, in the scan line drive example according to the present embodiment illustrated in FIG. 12, a period is provided in which the gate-on period of the scan line GL selected by the first gate drive circuit 43_1 overlaps the gate-on period of the scan line GL selected by the second gate drive circuit 43_2 (hereinafter, also called "overlap period").

Specifically, one horizontal scan period (1H) in the second half of the gate-on period of the scan lines GL(1) and GL(2) in the first partial region PAA1 that are simultaneously selected by the first gate drive circuit 43_1 overlaps one horizontal scan period (1H) in the first half of the gate-on period of the scan lines GL(N/2+1) and GL(N/2+2) in the second partial region PAA2 that are simultaneously selected by the second gate drive circuit 43_2. One horizontal scan period (1H) in the second half of the gate-on period of the scan lines GL(N/2+1) and GL(N/2+2) in the second partial region PAA2 that are simultaneously selected by the second gate drive circuit 43_2 overlaps one horizontal scan period (1H) in the first half of the gate-on period of the scan lines GL(3) and GL(4) in the first partial region PAA1 that are simultaneously selected by the first gate drive circuit 43_1. One horizontal scan period (1H) in the second half of the gate-on period of the scan lines GL(3) and GL(4) in the first partial region PAA1 that are simultaneously selected by the first gate drive circuit 43_1 overlaps one horizontal scan period (1H) in the first half of the gate-on period of the scan lines GL(N/2+3) and GL(N/2+4) in the second partial region PAA2 that are simultaneously selected by the second gate drive circuit 43_2. One horizontal scan period (1H) in the second half of the gate-on period of the scan lines GL(N/2-1) and GL(N/2) in the first partial region PAA1 that are simultaneously selected by the first gate drive circuit 43_1 overlaps one horizontal scan period (1H) in the first half of the gate-on period of the scan lines GL(N−1) and GL(N) in the second partial region PAA2 that are simultaneously selected by the second gate drive circuit 43_2.

Thus, by providing the overlap periods in which the gate-on periods of the scan lines GL overlap each other, the light emission periods RON, GON, and BON within 1 Field period can be made relatively further longer than those in the scan line drive example according to the comparative example illustrated in FIG. 11. Hereinafter, the scan line drive method of driving the scan lines GL by making the gate-on periods of the scan lines GL overlap each other is also called "gate-overlap drive".

Figure 13:
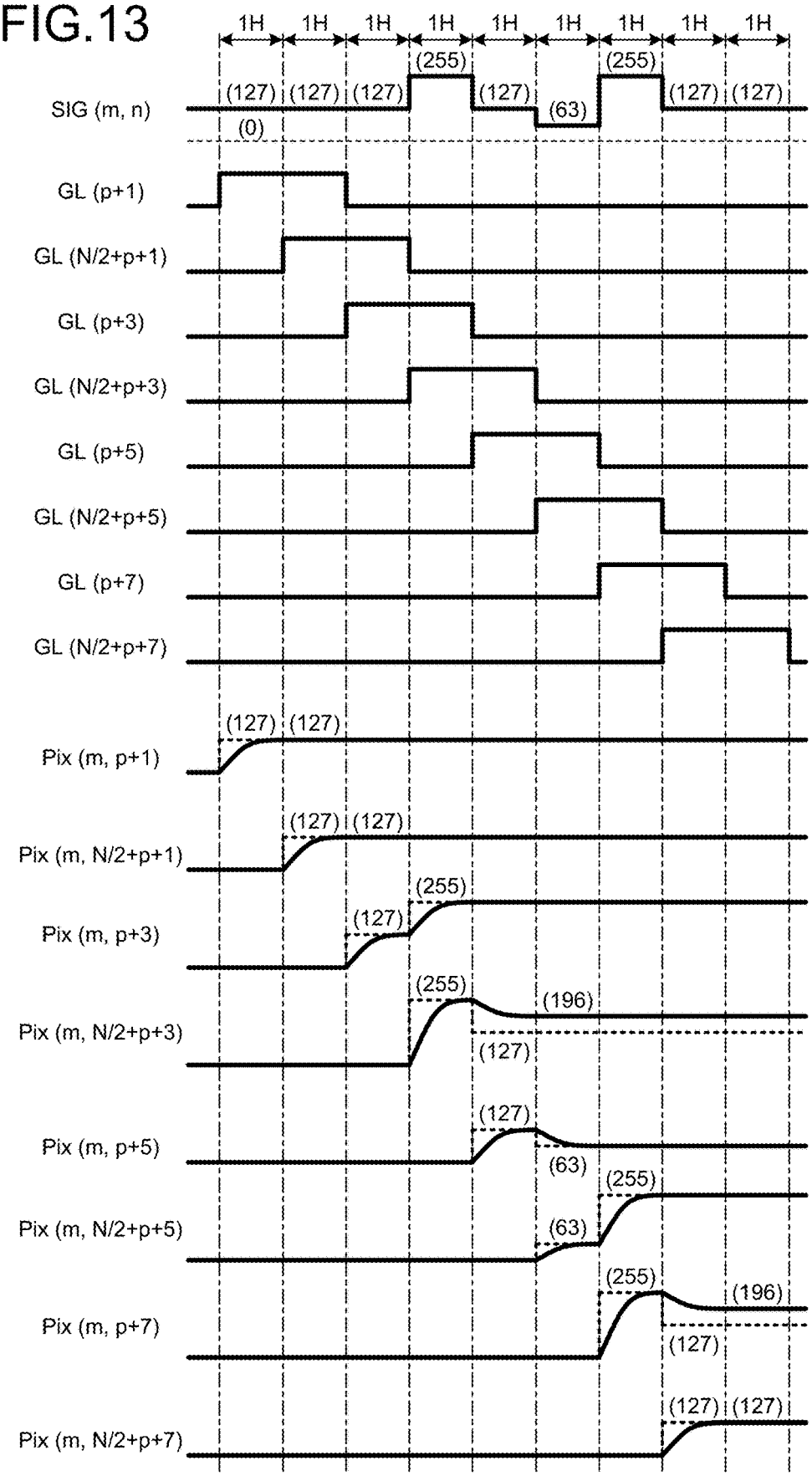
FIG. 13 is a conceptual diagram illustrating voltage changes of the pixel electrodes in the scan line drive example illustrated in FIG. 12.
Figure 14:
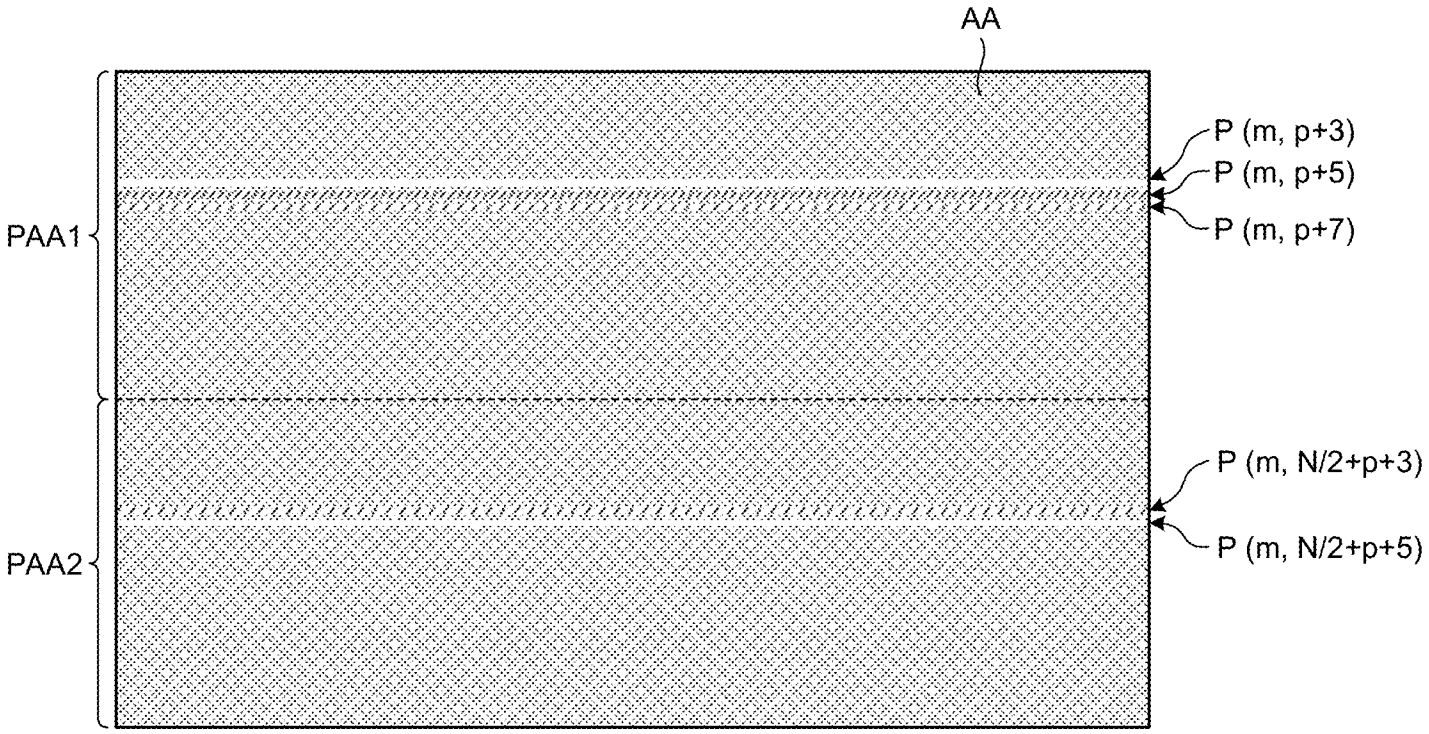
FIG. 14 depicts an illustrative image illustrating an example of occurrence of ghosting in the scan line drive example illustrated in FIG. 12.

FIG. 13 is a conceptual diagram illustrating voltage changes of the pixel electrodes in the scan line drive example illustrated in FIG. 12. FIG. 14 depicts an illustrative image illustrating an example of occurrence of ghosting in the scan line drive example illustrated in FIG. 12.

FIG. 13 illustrates gradation signals SIG(m, n) supplied to the pixels Pix in the m-th column (where m is a natural number from 1 to M). FIG. 13 illustrates the voltage changes of the pixel electrodes PE of the pixels Pix(m, n) (where n is a natural number from 1 to N) in the selection order of the scan lines GL illustrated in FIG. 12. The dashed lines illustrated in FIG. 13 indicate ideal values of the voltage changes of the pixel electrodes PE caused by the pixel gradation values written to the pixels Pix(m, n) during the gate-on periods of the respective scan lines GL(n).

FIG. 13 illustrates an example in which the gradation signal SIG(m, n) has a bit depth of 8 bits, that is, 256 gradations the values of which are in a range from "0" to "255" as the pixel gradation values. In the scan line drive example illustrated in FIG. 13, the pixel gradation value corresponding to the pixel Pix(m, p+3) in the (p+3)th row (where p is a natural number) and the pixel Pix(m, N/2+p+5) in the (N/2+p+5)th row is "255"; the pixel gradation value corresponding to the pixel Pix(m, p+5) in the (p+5)th row is "63"; and the pixel gradation value corresponding to the other pixels Pix(m, n) is "127".

In FIG. 13, in the gate-on period of the scan line GL(N/2+p+3) selected by the second gate drive circuit 43_2, the pixel Pix(m, N/2+p+3) is driven at a voltage for the pixel gradation value "255" of the pixel Pix(m, p+3) during the one horizontal scan period (1H) in the first half of the gate-on period that is relatively higher than a voltage for the original pixel gradation value "127" set for the one horizontal scan period (1H) in the second half of the gate-on period. As a result, the liquid crystal molecules in the pixel Pix(m, N/2+p+3) are charged with a voltage higher than the voltage for the original pixel gradation value "127".

In the subsequent one horizontal scan period (1H) in the second half of the gate-on period, the pixel Pix(m, N/2+p+3) is driven at a relatively lower voltage by the original pixel gradation value "127" of the pixel Pix(m, N/2+p+3). However, this operation may not sufficiently discharge the electric charge stored in the liquid crystal molecules of the pixel Pix(m, N/2+p+3) by the pixel gradation value "255" of the pixel Pix(m, p+3) during the one horizontal scan period (1H) in the first half of the gate-on period. FIG. 13 illustrates an example in which the potential has reached a potential corresponding to the pixel gradation value "196" larger than the original pixel gradation value "127" of the pixel Pix(m, N/2+p+3).

As a result, as illustrated in FIG. 14, what is called a ghosting that is not present in the original input signal may be visible at a location corresponding to the pixel Pix(m, N/2+p+3) in the second partial region PAA2 in the display region AA.

In FIG. 13, in the gate-on period of the scan line GL(p+7) selected by the first gate drive circuit 43_1, the pixel Pix(m, p+7) is driven at a voltage for the pixel gradation value "255" of the pixel Pix(m, N/2+p+5) during the one horizontal scan period (1H) in the first half of the gate-on period that is relatively higher than the voltage given by the original pixel gradation value "127" set for the one horizontal scan period (1H) in the second half of the gate-on period. As a result, the liquid crystal molecules in the pixel Pix(m, p+7) are charged with a voltage higher than the voltage for the original pixel gradation value "127".

In the subsequent one horizontal scan period (1H) in the second half of the gate-on period, the pixel Pix(m, p+7) is driven at a relatively lower voltage by the original pixel gradation value "127" of the pixel Pix(m, p+7). However, this operation may not sufficiently discharge the electric charge stored in the liquid crystal molecules of the pixel Pix(m, p+7) by the pixel gradation value "255" of the pixel Pix(m, p+5) during the one horizontal scan period (1H) in the first half of the gate-on period. FIG. 13 illustrates an example in which the potential has reached a potential corresponding to the pixel gradation value "196" larger than the original pixel gradation value "127" of the pixel Pix(m, p+7).

As a result, as illustrated in FIG. 14, the ghosting may be visible at a location corresponding to the pixel Pix(m, p+7) in the first partial region PAA1 in the display region AA.

Figure 15:
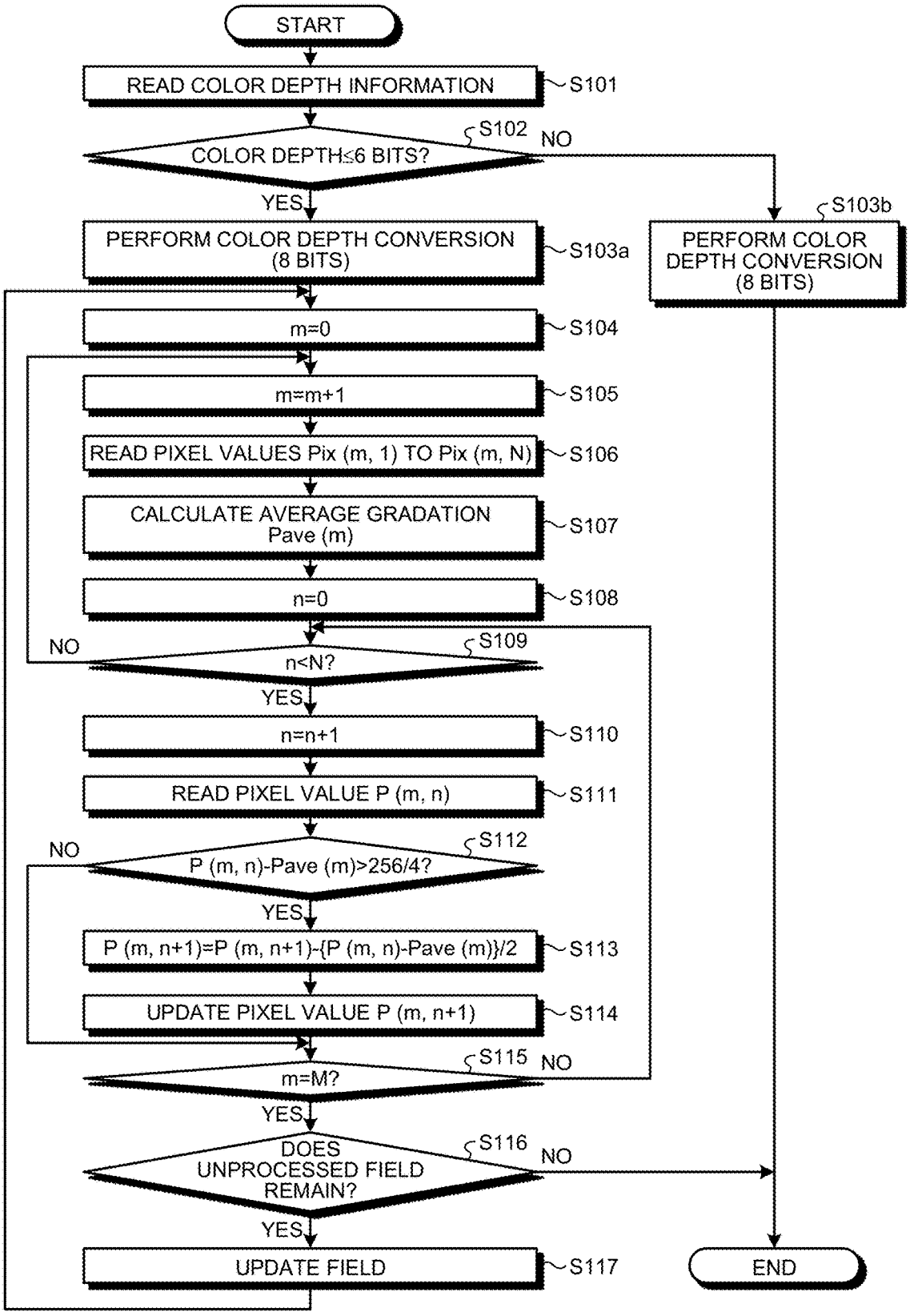
FIG. 15 is a flowchart illustrating an example of a pixel gradation value adjustment process in the display device according to the first embodiment.

The following describes, with reference to FIG. 15, a method that can reduce the ghosting caused by the high-voltage drive during the one horizontal scan period (1H) in the first half of the gate-on period in the configuration according to the first embodiment in which the gate-overlap drive is performed.

FIG. 15 is a flowchart illustrating an example of a pixel gradation value adjustment process in the display device according to the first embodiment. In the present embodiment, the signal processing circuit 41 performs the pixel gradation value adjustment process illustrated in FIG. 15 for each frame.

The signal adjuster 413 of the signal processing circuit 41 reads the color depth information on the first input signal VS from the storage 412 (Step S101) and determines whether the color depth of the first input signal VS is equal to or lower than a predetermined color depth (herein, 6 bits), that is, whether "color depth≤6 bits is satisfied (Step S102). If the color depth of the first input signal VS is higher than the predetermined color depth (6 bits, for example) (No at Step S102), the signal adjuster 413 performs a color depth conversion process on the second input signal VCS (Step S103*b*) and ends the pixel gradation value adjustment process.

For example, in natural pictures such as scenic images in which no rule (regularity) is present in the pixel gradation value of each of the pixels Pix, the ghosting as described above is difficult to be visible. In the present disclosure, if the color depth of the first input signal VS is higher than the predetermined color depth (herein, 6 bits) (No at Step S102), the image is regarded as a natural picture, and the adjustment process at and after Step S103*a* is not performed.

If the color depth of the first input signal VS is lower than the predetermined color depth (6 bits, for example) (Yes at Step S102), the color depth conversion process (herein, into 8 bits) is performed on the second input signal VCS (Step S103*a*).

The signal adjuster 413 initializes the value of a column number m to be subjected to the pixel gradation value adjustment (Step S104), increments the column number m to be subjected to the pixel gradation value adjustment (Step S105), reads pixel gradation values Pix(m, 1) to Pix (m, N) of the pixels Pix(m, n) in the m-th column to be subjected to the pixel gradation value adjustment (Step S106), and calculates an average gradation value Pave(m) of the pixel gradation values Pix(m, 1) to Pix (m, N) (Step S107). The average gradation value Pave(m) is calculated, for example, by Expression (1) below.

$$P\mathrm{ave}(m)=\{P(m,1)+P(m,2)+\ldots+P(m,N)\}/N \quad (1)$$

The signal adjuster 413 assumes that a row to be subjected to the pixel gradation value adjustment is n+1 and initializes the value of the row number n (Step S108).

The signal adjuster 413 then determines whether n<N (Step S109), and if n<N (Yes at Step S109), increments the value of the row number n (Step S110), reads the pixel gradation value P(m, n) of the pixel Pix(m, n) (Step S111), and determines whether the difference value between the pixel gradation value P(m, n) and the average gradation value Pave(m) exceeds a predetermined value (herein, ¼ of the number of gradations "256" of the gradation signal SIG(m, n)) at the maximum gradation (Step S112). The determination expression in the process at Step S112 can be represented by Expression (2) below.

$$P(m,n)-P\mathrm{ave}(m)>256/4 \quad (2)$$

If the difference value between the pixel gradation value P(m, n) and the average gradation value Pave(m) is equal to or smaller than a predetermined value (herein, 256/4=64) (No at Step S112), the signal adjuster 413 determines whether m=M (Step S115), and if m<M (No at Step S115), the process returns to the processing at Step S109.

If the difference value between the pixel gradation value P(m, n) and the average gradation value Pave(m) exceeds the predetermined value (herein, 256/4=64) (Yes at Step S112), the signal adjuster 413 calculates a value obtained by adjusting the pixel gradation value P(m, n) based on the average gradation value Pave(m) (Step S113). The calculated value is regarded as the pixel gradation value P(m, n+1) of the pixel Pix(m, n+1) to be subjected to the pixel gradation value adjustment, and with this value, the signal adjuster 413 updates the pixel gradation value P(m, n+1) temporarily stored in the storage 412 (Step S114). The pixel gradation value P(m, n+1) of the pixel Pix(m, n+1) to be subjected to the pixel gradation value adjustment is calculated, for example, by Expression (3) below.

$$P(m,n+1)=P(m,n+1)-\{P(m,n)-P\mathrm{ave}(m)\}/2 \quad (3)$$

If m<M in the process at Step S115 (No at Step S115) and n=N in the process at Step S109 (No at Step S109), the signal adjuster 413 repeats the processes at and after Step S105.

When m=M in the process at Step S115 (Yes at Step S115), the signal adjuster 413 determines whether the processes from Step S104 to Step S115 have ended in all the Fields, that is, R_Field, G_Field, and B_Field (Step S116). If an unprocessed Field remains (Yes at Step S116), the signal adjuster 413 updates the Field to be subjected to the pixel gradation value adjustment process (Step S117), and repeats the processes from Step S104 to Step S115.

If no unprocessed Field remains (No at Step S116), that is, if the processes at Steps S104 to S115 have ended in the R_Field, G_Field, and B_Field, the signal adjuster 413 ends the pixel gradation value adjustment process.

Figure 16:
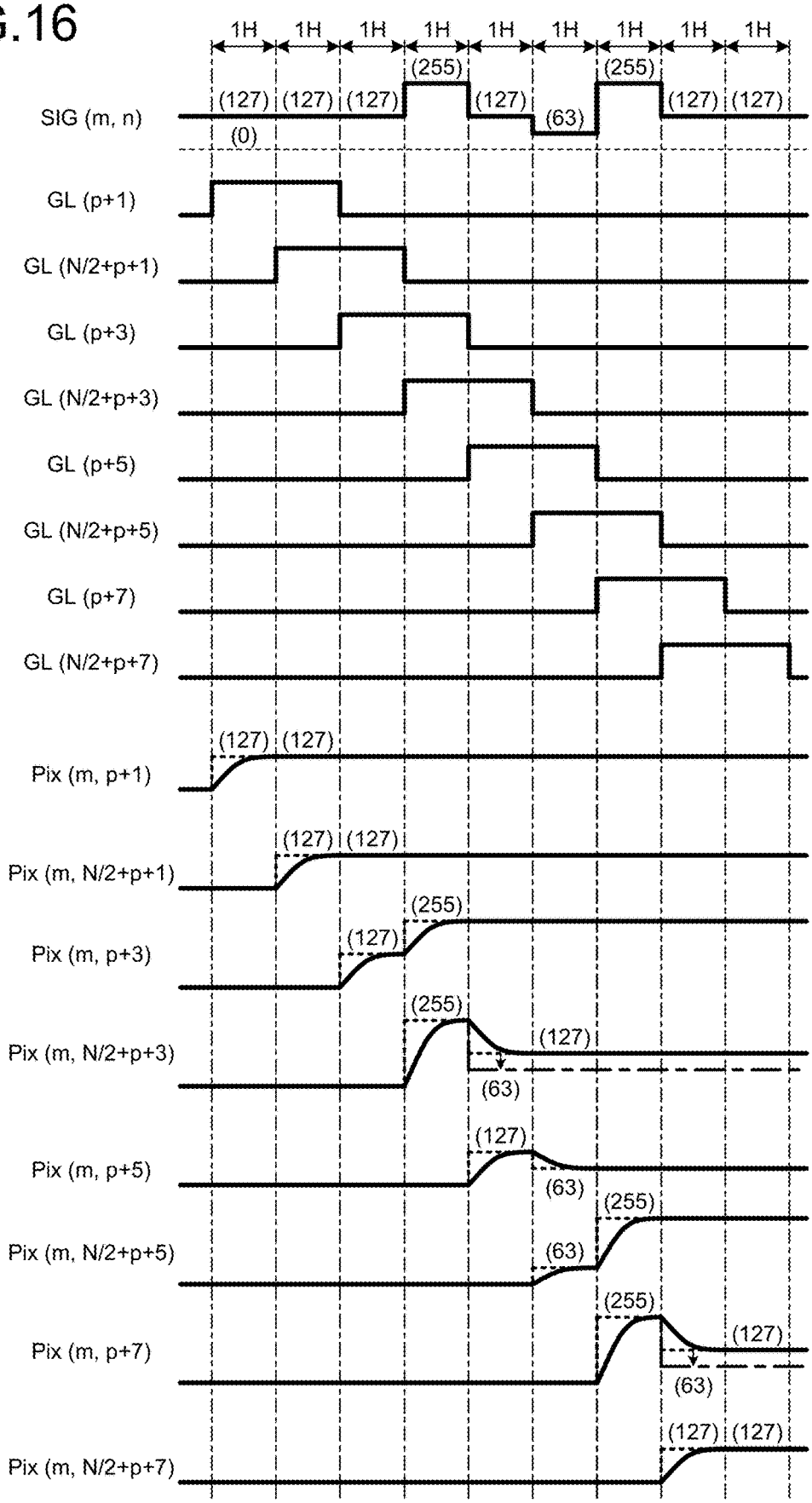
FIG. 16 is a conceptual diagram illustrating the voltage changes of the pixel electrodes when the pixel gradation value adjustment process is applied in the scan line drive example illustrated in FIG. 12.
Figure 17:
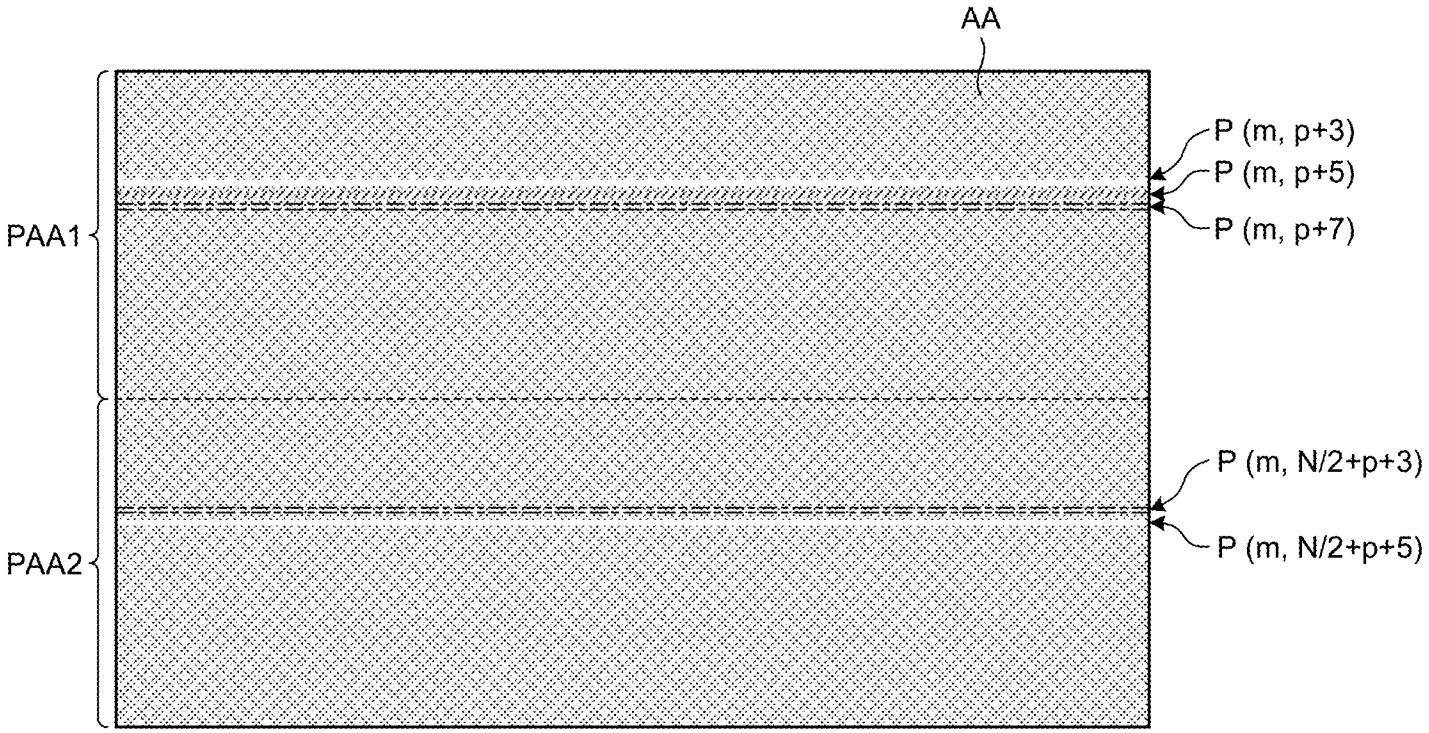
FIG. 17 depicts an illustrative image when the pixel gradation value adjustment process is applied in the scan line drive example illustrated in FIG. 12.

FIG. 16 is a conceptual diagram illustrating the voltage changes of the pixel electrodes when the pixel gradation value adjustment process is applied in the scan line drive example illustrated in FIG. 12. FIG. 17 depicts an illustrative image when the pixel gradation value adjustment process is applied in the scan line drive example illustrated in FIG. 12. FIGS. 16 and 17 correspond to FIGS. 13 and 14, respectively.

By applying the pixel gradation value adjustment process described above, the average gradation value Pave(m) can be expressed by Expression (4) below that is obtained by modifying Expression (1) above.

$$P\mathrm{ave}(m)=\{127\times(N-3)+255\times2+63\times1\}/N \quad (4)$$

In Expression (4) above, for example, when N=480, the average gradation value Pave(m) is 127.4. At this time, the pixel gradation value "255" of the pixel Pix(m, p+3) satisfies the conditional expression at Step S112 indicated by Expression (2) above (Yes at Step S112). At this time, the pixel gradation value P(m, N/2+p+3) of the pixel Pix(m, N/2+p+3) corresponding to the (n+1)th row to be subjected to the pixel gradation value adjustment is calculated to be "63.2" by Expression (3) above.

The signal adjuster 413 updates the pixel gradation value of the pixel Pix(m, N/2+p+3) to "63" based on the calculation result by Expression (3) above. This operation sets the potential of the pixel Pix(m, N/2+p+3) to a potential corresponding to the pixel gradation value "127" that is the original pixel gradation value, as illustrated in FIG. 16.

As a result, as illustrated in FIG. 17, the ghosting that would be visible at the location corresponding to the pixel Pix(m, N/2+p+3) in the second partial region PAA2 in the display region AA can be reduced.

The pixel gradation value "255" of the pixel Pix(m, N/2+p+5) satisfies the conditional expression at Step S112 indicated by Expression (2) above (Yes at Step S112). At this time, the pixel gradation value P(m, p+7) of the pixel Pix(m, p+7) corresponding to the (n+1)th row to be subjected to the pixel gradation value adjustment is calculated to be "63.2" by Expression (3) above.

The signal adjuster 413 updates the pixel gradation value of the pixel Pix(m, p+7) to "63" based on the calculation result by Expression (3) above. This operation sets the potential of the pixel Pix(m, p+7) to a potential corresponding to the original pixel gradation value "127" of the pixel Pix(m, p+7), as illustrated in FIG. 16.

As a result, as illustrated in FIG. 17, the ghosting that would be visible at the location corresponding to the pixel Pix(m, P+7) in the first partial region PAA1 in the display region AA can be reduced.

Second Embodiment

Figure 18:
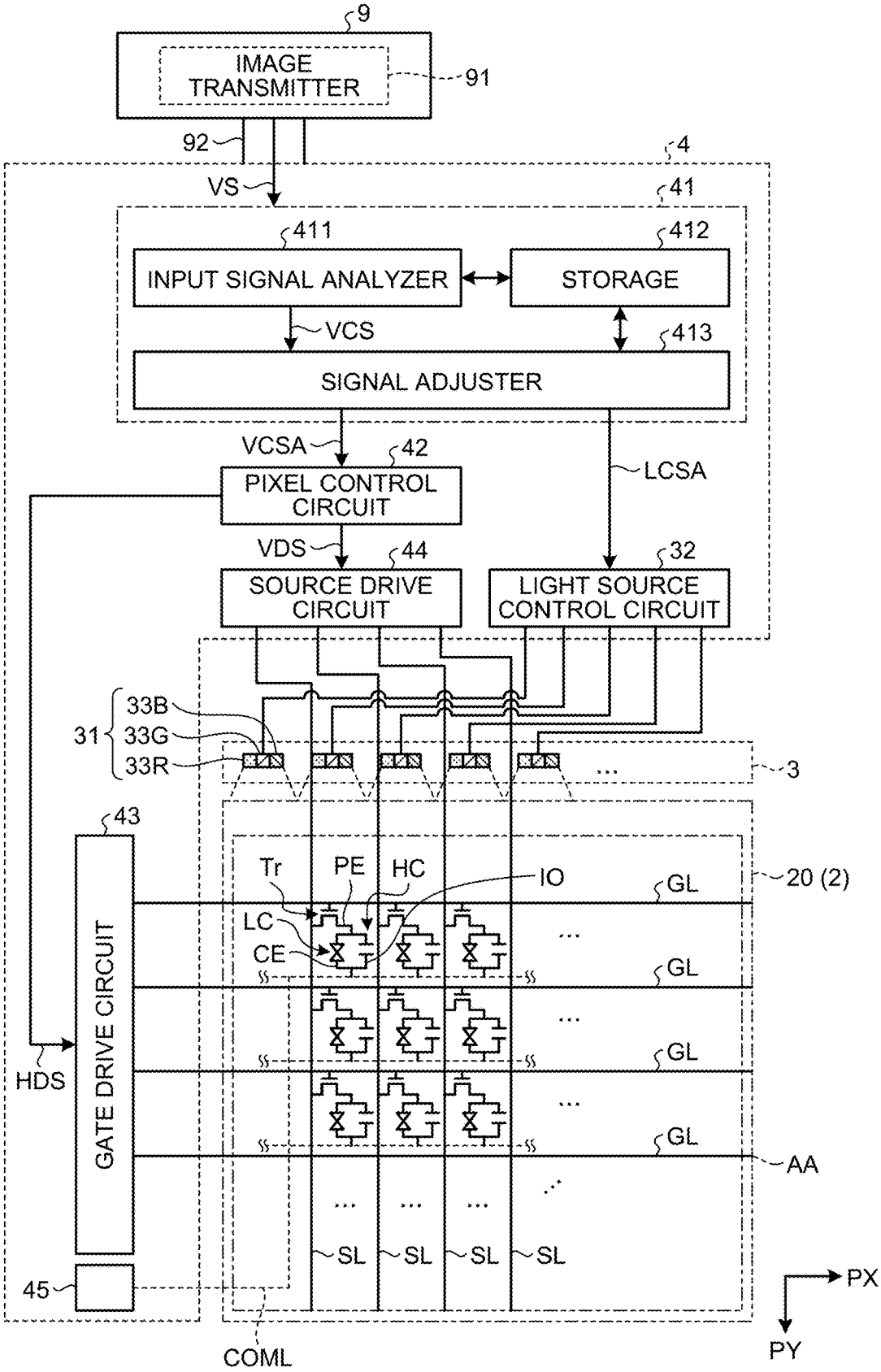
FIG. 18 is a block diagram illustrating an exemplary schematic configuration of the display device according to a second embodiment.
Figure 19:
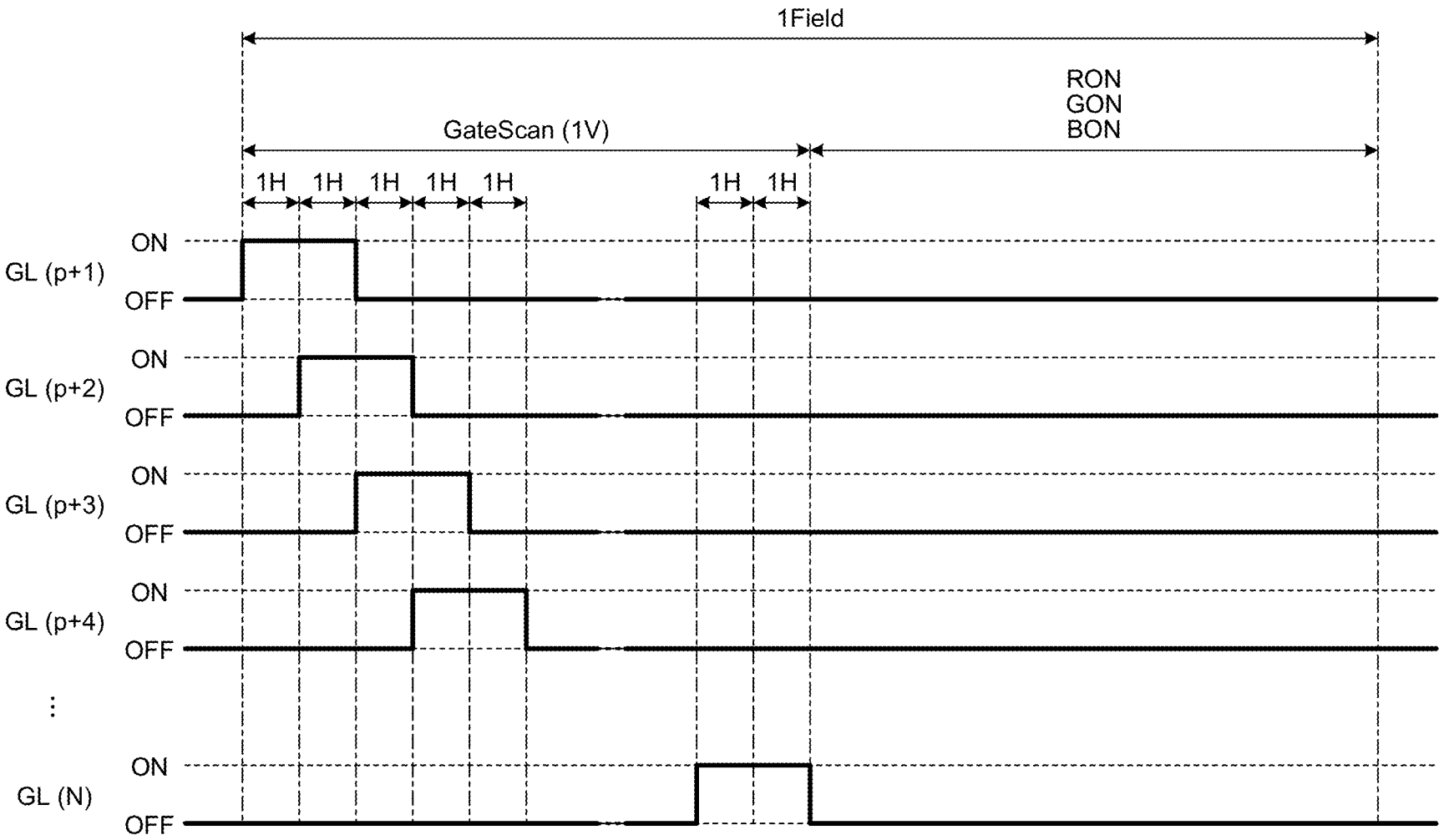
FIG. 19 is a timing diagram illustrating a scan line drive example according to the second embodiment.

FIG. 18 is a block diagram illustrating an exemplary schematic configuration of the display device according to a second embodiment. FIG. 19 is a timing diagram illustrating a scan line drive example according to the second embodiment. The same components as those in the first embodiment are denoted by the same reference numerals, and the detailed description thereof may be omitted.

In the first embodiment, the display region AA is divided into the two first and second partial regions PAA1 and PAA2, the first gate drive circuit (first scan line drive circuit) 43_1 is provided to select the scan lines GL in the first partial region PAA1, and the second gate drive circuit (second scan line drive circuit) 43_2 is provided to select the scan lines GL in the second partial region PAA2. Unlike the first embodiment, in the second embodiment, one gate drive circuit (scan line drive circuit) 43 selects the scan lines GL in the display region AA.

In the second embodiment, the signal lines SL are coupled to the pixels Pix in each row, unlike the first embodiment in which the signal lines SLodd coupled to the pixels Pix in the odd-numbered rows and the signal lines SLeven coupled to the pixels Pix in the even-numbered rows are provided.

In also the configuration according to the second embodiment illustrated in FIG. 18, the display device is driven based on the field-sequential system, and the horizontal drive signal HDS and the vertical drive signal VDS are generated for each color emittable by the light emitters 31, in the same manner as in the configuration according to the first embodiment.

In also the second embodiment, the same gate overlap drive as that of the first embodiment can relatively increase the light emission periods RON, GON, and BON within 1 Field period as illustrated in FIG. 19. Specifically, in the scan line drive example according to the second embodiment illustrated in FIG. 19, the one horizontal scan period (1H) in the second half of the gate-on period of the scan line GL(p+1) overlaps the one horizontal scan period (1H) in the first half of the gate-on period of the scan line GL(p+2). The one horizontal scan period (1H) in the second half of the gate-on period of the scan line GL(p+2) overlaps the one horizontal scan period (1H) in the first half of the gate-on period of the scan line GL(p+3). The one horizontal scan period (1H) in the second half of the gate-on period of the scan line GL(p+3) overlaps the one horizontal scan period (1H) in the first half of the gate-on period of the scan line GL(p+4).

Figure 20:
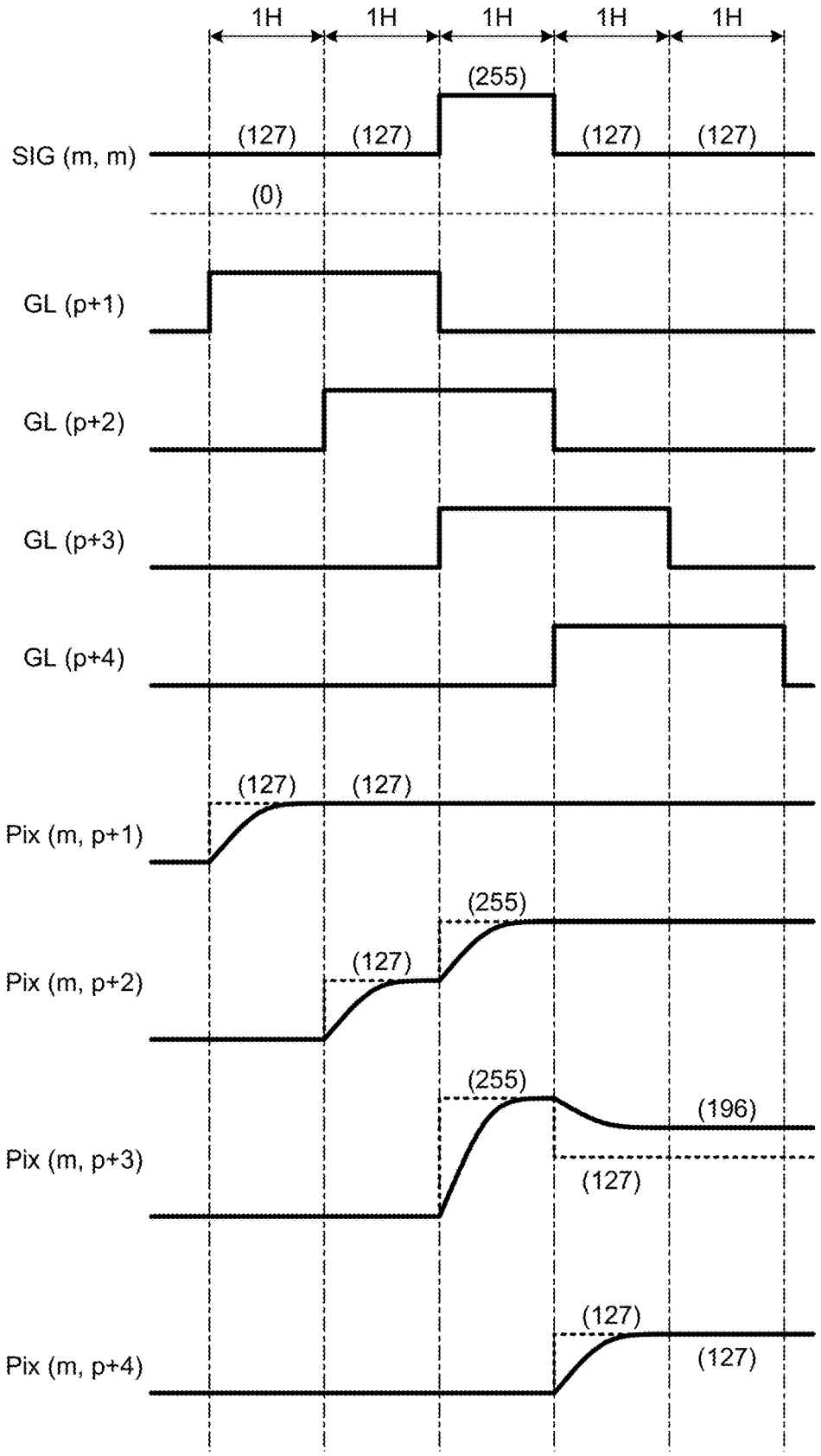
FIG. 20 is a conceptual diagram illustrating the voltage changes of the pixel electrodes in the scan line drive example illustrated in FIG. 19.
Figure 21:
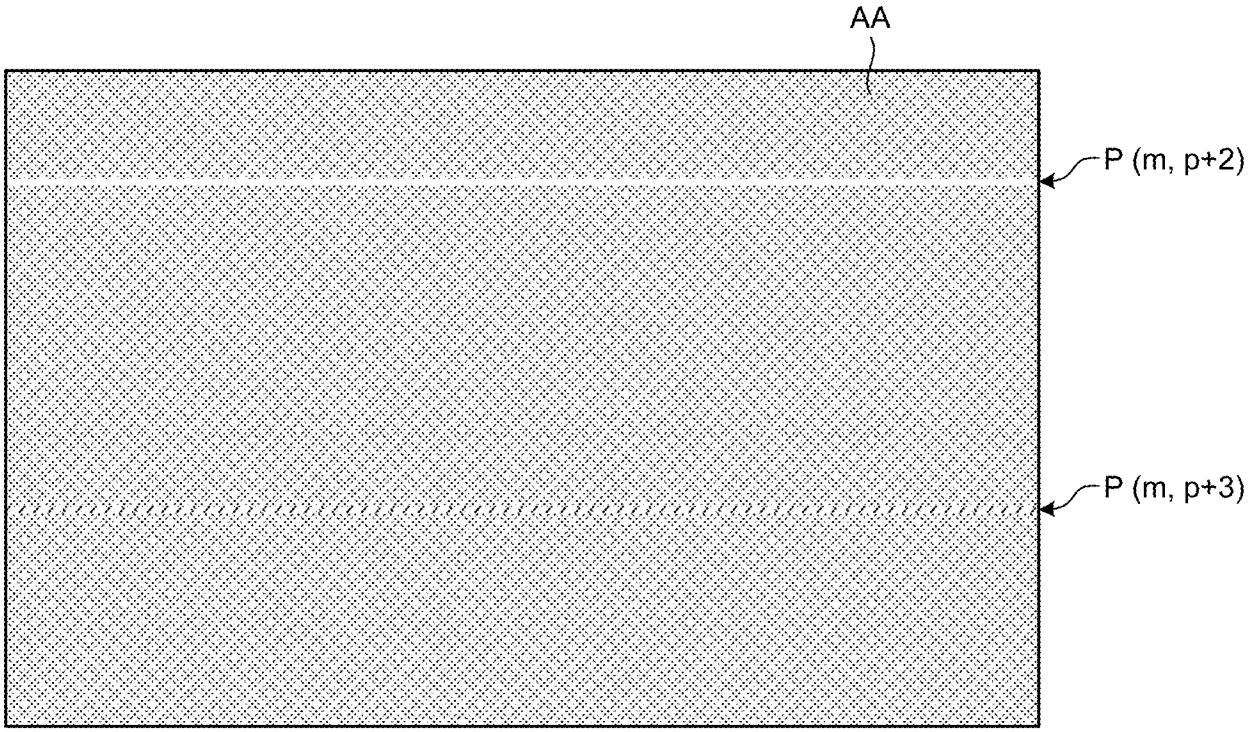
FIG. 21 depicts an illustrative image illustrating an example of the occurrence of ghosting in the scan line drive example illustrated in FIG. 19.

FIG. 20 is a conceptual diagram illustrating the voltage changes of the pixel electrodes in the scan line drive example illustrated in FIG. 19. FIG. 21 depicts an illustrative image illustrating an example of the occurrence of ghosting in the scan line drive example illustrated in FIG. 19.

FIG. 20 illustrates the gradation signals SIG(m, n) supplied to the pixels Pix in the m-th column. FIG. 20 illustrates the voltage changes of the pixel electrodes PE of the pixels Pix(m, n) in the selection order of the scan lines GL illustrated in FIG. 19. The selection order of the scan lines GL(p+1), GL(p+2), GL(p+3), and GL(p+4) need not be the same as the arrangement order thereof in the display region AA. The dashed lines illustrated in FIG. 20 indicate the ideal values of the voltage changes of the pixel electrodes PE caused by the pixel gradation values written to the pixels Pix(m, n) during the gate-on periods of the respective scan lines GL(n).

FIG. 21 illustrates an example in which the gradation signal SIG(m, n) has a bit depth of 8 bits, that is, 256 gradations the values of which are in a range from "0" to "255" as the pixel gradation values, in the same manner as in the first embodiment. In the scan line drive example illustrated in FIG. 21, the pixel gradation value corresponding to the pixel Pix(m, p+2) in the (p+2)th row is "255", and the pixel gradation value corresponding to the pixels Pix(m, n) other than the pixel Pix(m, p+2) is "127". In FIG. 21, the selection order of the scan lines GL(p+1), GL(p+2), GL(p+3), and GL(p+4) is not the same as the arrangement order thereof in the display region AA.

In FIG. 20, during the one horizontal scan period (1H) in the first half of the gate-on period of the scan line GL(p+3) selected by the gate drive circuit 43, the pixel gradation value of the pixel Pix(m, N/2+p+3) is driven by the pixel gradation value "255" of the pixel Pix(m, p+2) at a voltage relatively higher than the voltage given by the original pixel gradation value "127" set for the one horizontal scan period (1H) in the second half of the gate-on period. As a result, the liquid crystal molecules in the pixel Pix(m, p+3) are charged with a voltage higher than the voltage for the original pixel gradation value "127".

In the subsequent one horizontal scan period (1H) in the second half of the gate-on period, the pixel Pix(m, p+3) is driven at a relatively lower voltage by the original pixel gradation value "127" of the pixel Pix(m, p+3). However, this operation may not sufficiently discharge the electric charge stored in the liquid crystal molecules of the pixel Pix(m, p+3) by the pixel gradation value "255" of the pixel Pix(m, p+2) during the one horizontal scan period (1H) in the first half of the gate-on period. FIG. 20 illustrates an example in which the potential has reached a potential corresponding to the pixel gradation value "196" larger than the original pixel gradation value "127" of the pixel Pix(m, p+3).

As a result, as illustrated in FIG. 21, the ghosting may be visible at a location corresponding to the pixel Pix(m, p+3) in the display region AA.

In also the second embodiment, the same effect as that of the first embodiment can be obtained by the pixel gradation value adjustment process described in the first embodiment.

Figure 22:
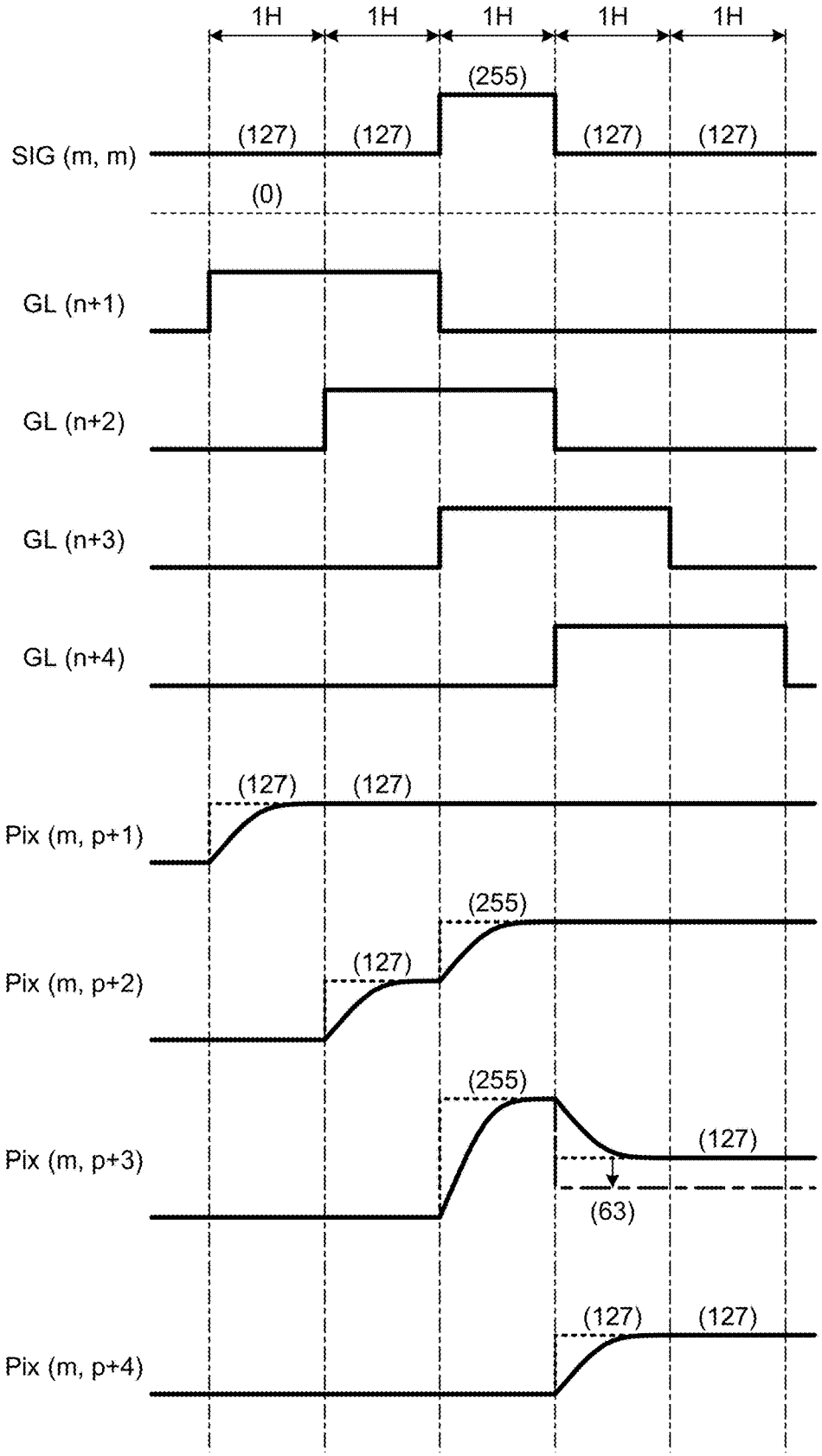
FIG. 22 is a conceptual diagram illustrating the voltage changes of the pixel electrodes when the pixel gradation value adjustment process is applied in the scan line drive example illustrated in FIG. 19.
Figure 23:
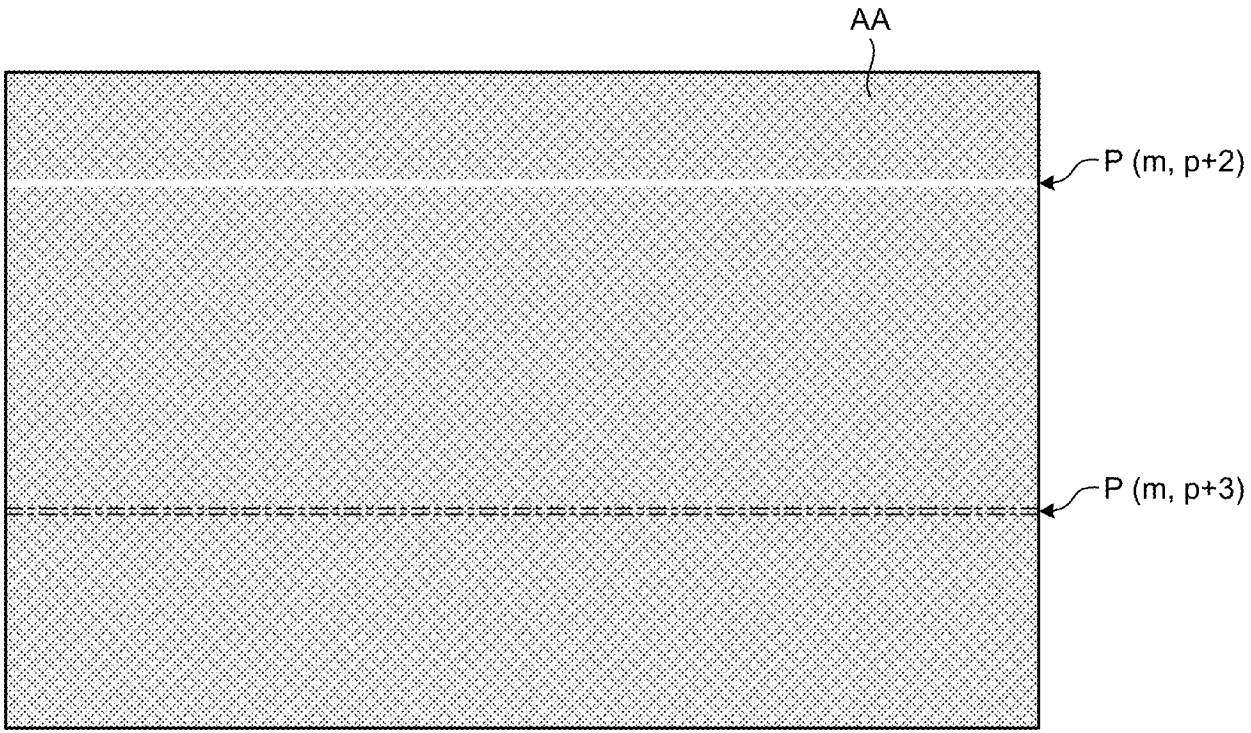
FIG. 23 depicts an illustrative image when the pixel gradation value adjustment process is applied in the scan line drive example illustrated in FIG. 19.

FIG. 22 is a conceptual diagram illustrating the voltage changes of the pixel electrodes when the pixel gradation value adjustment process is applied in the scan line drive example illustrated in FIG. 19. FIG. 23 depicts an illustrative image when the pixel gradation value adjustment process is applied in the scan line drive example illustrated in FIG. 19.

Specifically, by applying the pixel gradation value adjustment process described in the first embodiment, the average gradation value Pave(m) can be expressed by Expression (5) below that is obtained by modifying Expression (1) of the first embodiment.

$$P\mathrm{ave}(m)=\{127\times(N-1)+255\times 1\}/N \quad (5)$$

In Expression (5) above, for example, when N=480, the average gradation value Pave(m) is 127.3. At this time, the pixel gradation value "255" of the pixel Pix(m, p+2) satisfies the conditional expression (255−127.3>256/4) indicated by Expression (2) of the first embodiment. At this time, the pixel gradation value P(m, p+3) of the pixel Pix(m, p+3) corresponding to the (n+1)th row to be subjected to the pixel gradation value adjustment is calculated to be "63.1" by Expression (3) of the first embodiment.

The signal adjuster 413 updates the pixel gradation value of the pixel Pix(m, p+3) to "63" based on the calculation result by Expression (3) of the first embodiment. This operation sets the potential of the pixel Pix(m, p+3) to a potential corresponding to the pixel gradation value "127" that is the original potential, as illustrated in FIG. 22.

As a result, as illustrated in FIG. 23, the ghosting that would be visible at the location corresponding to the pixel Pix(m, p+3) in the display region AA can be reduced.

While the preferred embodiments have been described above, the present disclosure is not limited to such embodiments. The content disclosed in the embodiments is merely an example, and can be variously modified within the scope not departing from the gist of the present disclosure. Any modifications appropriately made within the scope not departing from the gist of the present disclosure also naturally belong to the technical scope of the present disclosure.

What is claimed is:

1. A display device comprising:

a display panel having a display region in which a plurality of pixels are arranged in a matrix having a row-column configuration;

a plurality of scan lines each coupled to the pixels arranged in a row direction;

a plurality of signal lines each coupled to the pixels arranged in a column direction;

a signal line drive circuit configured to supply, to each of the signal lines, a gradation signal corresponding to a pixel gradation value of each of the pixels arranged in the column direction;

a scan line drive circuit configured to select the scan lines; and a signal processing circuit configured to adjust the pixel gradation value, wherein the scan lines include a first scan line and a second scan line, a second half period of a selection period of the first scan line overlaps a first half period of a selection period of the second scan line, and the signal processing circuit is configured to adjust the pixel gradation value of the pixel in an m-th column (where m is a natural number) coupled to the second scan line when a difference value between the pixel gradation value of the pixel in the m-th column coupled to the first scan line and an average gradation value of the pixels arranged in the m-th column is larger than a predetermined value.

2. The display device according to claim 1, wherein the signal processing circuit is configured to subtract a half value of the difference value from the pixel gradation value of the pixel in the m-th column coupled to the second scan line.

3. The display device according to claim 2, wherein the predetermined value is ¼ of the number gradations of the gradation signal at a maximum gradation.

4. The display device according to claim 1, wherein the display panel has a first partial region and a second partial region obtained by dividing the display region into two regions in the column direction, the scan lines include a plurality of the first scan lines and a plurality of the second scan lines, some of the first scan lines and some of the second scan lines are provided in the first partial region, and the others of the first scan lines and the others of the second scan lines are provided in the second partial region, the second half period of the selection period of one of the first scan lines in the first partial region overlaps the first half period of the selection period of one of the second scan lines in the second partial region, and the second half period of the selection period of one of the first scan lines in the second partial region overlaps the first half period of the selection period of one of the second scan lines in the first partial region.

5. The display device according to claim 4, wherein the scan line drive circuit comprises:

a first scan line drive circuit configured to select the scan lines in the first partial region; and a second scan line drive circuit configured to select the scan lines in the second partial region.

* * * * *